US008776696B2

(12) United States Patent
Okubo et al.

(10) Patent No.: US 8,776,696 B2
(45) Date of Patent: Jul. 15, 2014

(54) LOW FLOOR VEHICLE

(75) Inventors: Yoshiki Okubo, Mihara (JP); Hiroyuki Kono, Hiroshima (JP); Kousuke Katahira, Kawasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 213 days.

(21) Appl. No.: 13/148,731

(22) PCT Filed: Jun. 16, 2009

(86) PCT No.: PCT/JP2009/060913
§ 371 (c)(1),
(2), (4) Date: Oct. 28, 2011

(87) PCT Pub. No.: WO2010/095286
PCT Pub. Date: Aug. 26, 2010

(65) Prior Publication Data

US 2012/0048139 A1 Mar. 1, 2012

(30) Foreign Application Priority Data

Feb. 20, 2009 (JP) ..... 2009-037990

(51) Int. Cl.
*B61F 5/38* (2006.01)

(52) U.S. Cl.
USPC ..... 105/158.2; 105/199.1; 105/182.1

(58) Field of Classification Search
USPC ..... 105/157.1, 158.1, 158.2, 182.1, 199.1
See application file for complete search history.

(56) References Cited

U.S. PATENT DOCUMENTS

| | | | | |
|---|---|---|---|---|
| 4,542,699 | A | 9/1985 | Smith | |
| 5,448,953 | A * | 9/1995 | Bieker et al. | 105/158.2 |
| 8,418,628 | B2 * | 4/2013 | Okubo et al. | 105/182.1 |

FOREIGN PATENT DOCUMENTS

| | | | |
|---|---|---|---|
| JP | 3917470 | A | 8/1964 |
| JP | 60113768 | A | 6/1985 |
| JP | 61-1075053 | A | 4/1986 |
| JP | 61-241259 | A | 10/1986 |
| JP | 2-034465 | A | 2/1990 |
| JP | 2-91070 | U | 7/1990 |
| JP | 3-258655 | A | 11/1991 |

(Continued)

OTHER PUBLICATIONS

JP Office Action for 2009-037990 dated Aug. 30, 2011.

(Continued)

*Primary Examiner* — S. Joseph Morano
*Assistant Examiner* — Zachary Kuhfuss
(74) *Attorney, Agent, or Firm* — Lowe Hauptman & Ham LLP

(57) ABSTRACT

A low floor vehicle can reduce, during curved track traveling of a vehicle, the lateral pressure of the vehicle, can prevent occurrence of vibration and creaking sounds of the vehicle, can improve riding comfort for passengers, and can reduce wear of wheel flanges, is provided.

The low floor vehicle includes: a journal member which couples a pair of wheels and is attached to a truck frame; and a truck frame lateral beam arranged along a vehicle width direction closer to the center of the truck frame than the journal member. The journal member can turn with respect to the truck frame. A coupling member which couples the journal member and the truck frame lateral beam is provided. The coupling member is attached to the center in the vehicle width direction of the truck frame lateral beam so as to be pivotable around an axis extending in a vehicle height direction.

4 Claims, 14 Drawing Sheets

(56) References Cited

FOREIGN PATENT DOCUMENTS

| | | | |
|---|---|---|---|
| JP | 5-085358 | A | 4/1993 |
| JP | 6-087446 | A | 3/1994 |
| JP | 9-002263 | A | 1/1997 |
| JP | 9-226576 | A | 9/1997 |
| JP | 11509161 | A | 8/1999 |
| JP | 2002-211392 | A | 7/2002 |
| JP | 2004-161115 | A | 6/2004 |
| JP | 2008-132828 | A | 6/2008 |
| JP | 2008162455 | A | 7/2008 |

OTHER PUBLICATIONS

International Search Report for PCT/JP2009/060913 mailed Aug. 18, 2009.

Notice of Allowance dated Jun. 12, 2013 corresponds to Korean Patent Application No. 10-2011-7019210.

* cited by examiner

LOW FLOOR VEHICLE

RELATED APPLICATIONS

The present application is a National Phase of International Application Number PCT/JP2009/060913, filed Jun. 16, 2009 and claims priority from, Japanese Application Number 2009-037990, filed Feb. 20, 2009.

TECHNICAL FIELD

The present invention relates to a low floor vehicle that travels on a track.

BACKGROUND ART

In recent years, streetcars and the like have adopted a low floor vehicle design in which a floor surface in the vehicle is set close to a road surface to reduce the difference in level when passengers step up and step down so as to make the vehicles "barrier-free". In such a streetcar, because of limitations such as road traffic conditions, a large number of curved tracks curving at a curvature radius equal to or less than 20 m are provided. There is a problem in that when the vehicle enters a curved track, an angle in a traveling direction of wheels with respect to a tangential direction of the curved track (hereinafter referred to as "attack angle") increases. When this attack angle is large, in wheels present on an outside rail during traveling on the curved track, in some cases, flanges of the wheels come into contact with the track. At this point, pressure is applied from the wheel flanges to the vehicle, the lateral pressure of the vehicle increases, and vibration and creaking sounds occur in the vehicle. As a result, there is a problem in that riding comfort of passengers is degraded and the wheel flanges wear out.

While taking such a problem into account, a low floor vehicle called an LRV (Light Rail Vehicle) as disclosed in Patent Literature 1 has been developed. In FIG. 13, an example of the configuration of this LRV is shown. A traveling direction of this LRV is indicated by an arrow A. In the explanation, it is assumed that the traveling direction is a vehicle front. Referring to FIG. 13, the LRV includes two front vehicles 102 and one intermediate vehicle 103 traveling on a track 101. As a vehicle composition, the one intermediate vehicle 103 is arranged between the two front vehicles 102.

Pin connectors 105 are arranged along an axis which extends in a vehicle vertical direction in connecting sections 104 between the front vehicles 102 and the intermediate vehicle 103. The front vehicles 102 are coupled to the intermediate vehicle 103 to be capable of turning around the pin connectors 105. Therefore, the front vehicles 102 and the intermediate vehicle 103 can curve around the pin connectors 105 so as to correspond to a curvature radius R of the curved track 101. Furthermore, in the connecting sections 104, any of dampers, springs, and the like (not shown) may be provided to suppress the turning of the front vehicles 102 and to secure safety during high-speed traveling of the vehicle.

Trucks 107 are arranged under vehicle bodies 106 of the front vehicles 102. As shown in FIGS. 14 to 16, a pair of left and right wheels 108 is provided on each of a vehicle front side and a vehicle rear side of the truck 107. The pair of wheels 108 is configured to be pivotable independently from each other around the same axis 108*a* which extends in a vehicle width direction, and is coupled by a journal member 109. The journal member 109 is arranged on each of a vehicle front side and a vehicle rear side of each of truck frames 110. The truck frames are formed as frame members of the truck 107. A conical rubber 111 is provided as a shaft spring for the wheel 108 between the journal member 109 and the truck frame 110. Vibration transmitted from the wheel 108 to the truck frame 110 is suppressed by this conical rubber 111. Furthermore, the journal member 109 extends in a position close to the road surface between the pair of wheels 108. A floor surface (not shown) in the vehicle is arranged on the journal member 109. Therefore, the floor surface in the vehicle is configured to be close to the road surface.

Referring to FIG. 13 again, when the vehicle traveling in the traveling direction enters the curved track 101, force directed in a straight forward direction by inertia acts on the vehicle bodies 106. Force directed in a tangential direction of the curved track acts on the trucks 107. Therefore, force acting on the entire front vehicles 102 is unbalanced. At this point, the straight forward force by inertia also affects the trucks 107. The trucks 107 are less easily curved along the curved track 101. As a result, an attack angle $\alpha$, which is an angle in the traveling direction (indicated by an arrow C) of the wheel 108 with respect to the tangential direction (indicated by an arrow B) of the curved track, increases. It is likely that wheel flanges 108*b* (shown in FIGS. 14 to 16) of the wheels 108 on an outside rail side come into contact with the track. At the time of this contact, pressure is applied from the wheel flanges 108*b* to the vehicle, lateral pressure of the vehicle increases, and vibration and creaking sounds occur in the vehicle. As a result, there is a problem in that riding comfort of passengers is degraded and the wheel flanges 108*b* wear out.

To absorb such unbalance of force, the trucks 107 are configured to be movable in the vehicle width direction with respect to the vehicle bodies 106. Specifically, as shown in FIGS. 14 to 16, traction rods 112 which transmit traction force of the truck 107 to the vehicle body 106 are arranged along a vehicle longitudinal direction. Ends 112*a* on the vehicle rear side of the traction rods 112 are attached to the truck 107 side via a spherical bush or a rubber vibration insulator (not shown). Ends 112*b* on the vehicle front side of the traction rods 112 are attached to the vehicle body 106 side via a spherical bush or a rubber vibration insulator (not shown).

CITATION LIST

Patent Literature

Patent Document 1: Japanese Patent Unexamined Publication No. 2008-132828

SUMMARY OF INVENTION

Technical Problem

However, in the vehicle of Patent Document 1, as shown in FIG. 13, the front vehicles 102 and the intermediate vehicle 103 are about to curve around the pin connectors 105 so as to correspond to the curvature radius R of the curved track 101 during the traveling of the vehicle on the curved track. However, in some cases, the front vehicles 102 do not sufficiently curve with respect to the intermediate vehicle 103 because of the influence of the dampers of the connecting sections 104. In some cases, the wheels 108 do not curve along the curved track while being affected by cant, slack, or the like of the curved track. In this case, it is likely that the traveling direction (indicated by the arrow B) of the wheels 108 does not face the tangential direction (indicated by the arrow C) of the curved track 101 and the attack angle $\alpha$ increases. Therefore, the pressure is still applied from the wheel flanges 108*b* to the vehicle, the lateral pressure of the vehicle increases, and vibration and creaking sounds occur in the vehicle. As a result, there are problems in that riding comfort of passengers is degraded and the wheel flanges 108*b* wear out.

As a further problem, a difference between forces acting on the vehicle bodies 106 and the trucks 107, is absorbed when the vehicle enters the curved track, and therefore, it is likely that, even if the trucks 107 move in the vehicle width direction with respect to the vehicle bodies 106, the straight forward force by inertia is large and imbalance of the force cannot be completely absorbed. In this case, the trucks 107 are still affected by the straight forward force by inertia. In some case, the attack angle $\alpha$ increases. Accordingly, there still results in the problems as above occurring.

The present invention has been devised in view of such circumstances, and it is an object of the present invention to provide a low floor vehicle which can reduce, when the vehicle travels a curved track, the lateral pressure of the vehicle, can prevent occurrence of vibration and creaking sounds of the vehicle, can improve riding comfort for passengers, and can reduce wear of wheel flanges.

Solution to Problems

In order to solve the problems, a low floor vehicle of the present invention is a low floor vehicle including: a truck arranged under a vehicle body; a truck frame configured as a frame member of the truck; a pair of wheels being pivotable independently from each other around the same axis which extends in a vehicle width direction and traveling on a track; a journal member which couples the pair of wheels and is attached to the truck frame; and a truck frame lateral beam arranged along the vehicle width direction in a position closer to the center in a vehicle longitudinal direction of the truck frame than the journal member; wherein the pair of wheels, the journal member, and the truck frame lateral beam are provided on each of a vehicle front side and a vehicle rear side of the truck, wherein the journal member can turn with respect to the truck frame, a coupling member which couples the journal member and the truck frame lateral beam, is provided, and wherein the coupling member is attached to the center in the vehicle width direction of the truck frame lateral beam so as to be pivotable around an axis extending in a vehicle height direction.

In the present invention, a restoring rod or a horizontal damper being arranged along the vehicle longitudinal direction and being retractable in the vehicle longitudinal direction, is provided in the truck, one end of the restoring rod or the horizontal damper is attached to the journal member, and the other end of the restoring rod or the horizontal damper is attached to the truck frame lateral beam.

In the present invention, an actuator being arranged on at least one of left and right outer sides in the vehicle width direction of the coupling member and being capable of reciprocatingly moving in the vehicle longitudinal direction, is provided in the truck, one end of the actuator is attached to the journal member, the other end of the actuator is attached to the truck frame lateral beam, and operations of the actuator are controlled so as to correspond to a linear traveling state of the vehicle and a curved traveling state of the vehicle, whereby the journal member can turn with respect to the truck frame.

In the present invention, a stopper member, provided in the truck frame, is arranged on the outer side in the vehicle width direction of the coupling member to be capable of coming into contact with the coupling member so as to regulate the pivotal movement of the coupling member.

Furthermore, in order to solve the problems, a low floor vehicle of the present invention is a low floor vehicle including: a truck arranged under a vehicle body; a truck frame configured as a frame member of the truck; a pair of wheels being pivotable independently from each other around the same axis which extends in a vehicle width direction and traveling on a track; a journal member which couples the pair of wheels and is attached to the truck frame; and a truck frame lateral beam arranged along the vehicle width direction in a position closer to the center in a vehicle longitudinal direction of the truck frame than the journal member, wherein the pair of wheels, the journal member, and the truck frame lateral beam are provided on each of a vehicle front side and a vehicle rear side of the truck, wherein the journal member can turn with respect to the truck frame, a first coupling member including a coupling section which extends between the journal member and the truck frame lateral beam on a vehicle front side and an interlocking lever section which extends along the vehicle longitudinal direction from the truck frame toward the center of the truck frame of the vehicle, is provided; wherein a second coupling member including a coupling section which extends between the journal member and the truck frame lateral beam on a vehicle rear side and an interlocking lever section which extends along the vehicle longitudinal direction from the truck frame toward the center of the truck frame of the vehicle, is provided; wherein the coupling section is attached to the center in the vehicle width direction of the truck frame lateral beam so as to be pivotable around an axis extending in a vehicle height direction, wherein a coupling pin is attached to the distal end of one of the interlocking lever sections in the first coupling member and the second coupling member, wherein a long hole extending in the vehicle longitudinal direction, is provided at the distal end of the other of the interlocking lever sections of the first coupling member and the second coupling member, wherein the coupling pin and the long hole engage with each other, whereby the first coupling member and the second coupling member are pivotable in synchronization with each other, and the journal member can turn with respect to the truck frame.

In the present invention, a restoring rod or a horizontal damper being arranged along the vehicle width direction and being retractable in the vehicle width direction, is provided in the truck, one end of the restoring rod or the horizontal damper is attached to one of the interlocking lever sections of the first stub link and the third stub link, and the other end of the restoring rod or the horizontal damper is attached to the truck frame.

In the present invention, an actuator being arranged along the vehicle width direction and being capable of reciprocatingly moving in the vehicle width direction, is provided in the truck, one end of the actuator is attached to one of the interlocking lever sections of the first coupling member and the second coupling member, the other end of the actuator is attached to the truck frame, and operations of the actuator are controlled so as to correspond to a linear traveling state of the vehicle and a curved traveling state of the vehicle, whereby the journal member can turn with respect to the truck frame.

Advantageous Effects of Invention

According to the present invention, effects explained below can be obtained. A low floor vehicle of the present invention is a low floor vehicle including: a truck arranged under a vehicle body; a truck frame configured as a frame member of the truck; a pair of wheels being pivotable independently from each other around the same axis which extends in a vehicle width direction and traveling on a track; a journal member which couples the pair of wheels and is attached to the truck frame; and a truck frame lateral beam arranged along the vehicle width direction in a position closer to the center in a vehicle longitudinal direction of the truck frame than the journal member; wherein the pair of wheels, the journal member, and the truck frame lateral beam are provided on each of a vehicle front side and a vehicle rear side of the truck, wherein the journal member can turn with respect to the truck frame, a coupling member which couples the journal member and the truck frame lateral beam is provided, and wherein the coupling member is attached to the center in the vehicle width direction of the truck frame lateral beam so as to be pivotable around an axis extending in a vehicle height direction.

Therefore, when the vehicle enters a curved track, if a wheel on an outside rail side of the pair of wheels comes into contact with the track and force directed to the inner side in the vehicle width direction is applied to the journal member, the journal member turns around an attaching section of the coupling member and the truck frame lateral beam. At this point, the wheel on the outside rail side moves away from the center in the longitudinal direction of the truck, and the wheel on an inside rail side of the pair of wheels moves toward the center in the longitudinal direction of the truck. As a result, the wheel changes to a state along the curved track and the vehicle can enter the curved track at a small attack angle. Therefore, contact pressure between the wheel on the outside rail side and the track is relaxed, lateral pressure on the vehicle is reduced, and occurrence of vibration and creaking sounds of the vehicle are prevented. Therefore, riding comfort for passengers is improved, and wear of a wheel flange is reduced.

In the low floor vehicle of the present invention, a restoring rod or a horizontal damper being arranged along the vehicle longitudinal direction and being retractable in the vehicle longitudinal direction, is provided in the truck, one end of the restoring rod or the horizontal damper is attached to the journal member, and the other end of the restoring rod or the horizontal damper is attached to the truck frame lateral beam. The restoring rod or the horizontal damper allow the journal member to return from a pivoted state during curved track traveling of the vehicle, to a state during linear track traveling of the vehicle. Furthermore, the restoring rod or the horizontal damper can absorb swing of the journal member during the linear track traveling. Occurrence of deflection of the wheels involved in such swing can be prevented. Therefore, the effects explained above can be more surely obtained, while traveling stability during the linear track traveling of the vehicle is improved.

In the low floor vehicle of the present invention, an actuator being arranged on at least one of left and right outer sides in the vehicle width direction of the coupling member and being capable of reciprocatingly moving in the vehicle longitudinal direction, is provided in the truck, one end of the actuator is attached to the journal member, and the other end of the actuator is attached to the truck frame lateral beam, so that the actuator can control the turn of the journal member. Therefore, for example, the actuator operates so as to correspond to the curved track, so that the wheel attached to the journal member can more surely enter a curved track at a small attack angle.

In the low floor vehicle of the present invention, a stopper member provided in the truck frame is arranged on the outer side in the vehicle width direction of the coupling member to be capable of coming into contact with the coupling member so as to regulate the pivotal movement of the coupling member. A pivoting amount of the coupling member is restricted by the stopper member. As a result, a turning amount of the journal member and a moving amount of the wheels are restricted. Therefore, the effects explained above can be more surely obtained while large movement of the wheels is prevented and traveling stability of the vehicle is secured.

In addition, a low floor vehicle of the present invention is a low floor vehicle including: a truck arranged under a vehicle body; a truck frame configured as a frame member of the truck; a pair of wheels being pivotable independently from each other around the same axis which extends in a vehicle width direction and traveling on a track; a journal member which couples the pair of wheels and is attached to the truck frame; and a truck frame lateral beam arranged along the vehicle width direction in a position closer to the center in a vehicle longitudinal direction of the truck frame than the journal member; wherein the pair of wheels, the journal member, and the truck frame lateral beam are provided on each of a vehicle front side and a vehicle rear side of the truck, wherein the journal member can turn with respect to the truck frame; wherein a first coupling member including a coupling section which extends between the journal member and the truck frame lateral beam on a vehicle front side and an interlocking lever section which extends along the vehicle longitudinal direction from the truck frame toward the center of the truck frame of the vehicle, is provided, wherein a second coupling member including a coupling section which extends between the journal member and the truck frame lateral beam on a vehicle rear side and an interlocking lever section which extends along the vehicle longitudinal direction from the truck frame toward the center of the truck frame of the vehicle, is provided, wherein the coupling section is attached to the center in the vehicle width direction of the truck frame lateral beam so as to be pivotable around an axis extending in a vehicle height direction, wherein a coupling pin is attached to the distal end of one of the interlocking lever sections of the first coupling member and the second coupling member, wherein a long hole extending in the vehicle longitudinal direction, is provided at the distal end of the other of the interlocking lever sections of the first coupling member and the second coupling member, wherein the coupling pin and the long hole engage with each other, whereby the first coupling member and the second coupling member are pivotable in synchronization with each other, and the journal member can turn with respect to the truck frame.

Therefore, in the case in which the vehicle enters a curved track, if a wheel on an outside rail side of the pair of wheels comes into contact with the track and force directed to the inner side in the vehicle width direction is applied to the journal member on the vehicle front side, the journal member turns around an attaching section of the first coupling member and the truck frame lateral beam. At this point, regarding the pair of wheels on the vehicle front side, the wheel on the outside rail side moves toward the vehicle front side, and the wheel on the inside rail side moves toward the vehicle rear side. As a result, the wheels change to a state in which the wheels more surely run along the curved track. The wheels can enter the curved track at a small attack angle.

When the journal member on the vehicle front side turns, the first coupling member and the second coupling member pivot in association with each other, and the journal member on the vehicle rear side turns in association with the journal member on the vehicle front side. Therefore, even if the truck is affected by force acting on the vehicle, and cant and slack of the curved track, the journal members on the vehicle front side and the vehicle rear side, can surely turn in association with each other so as to correspond to the curved track without separately moving. As a result, the wheels provided in the journal members, change to a state in which the wheels more surely run along the curved track. The wheels can enter the curved track at a small attack angle. Therefore, when the vehicle enters the curved track, contact pressure between the wheel on the outside rail side and the track is relaxed, lateral pressure on the vehicle is reduced, and occurrence of vibration and creaking sounds of the vehicle are prevented. Therefore, riding comfort for passengers is improved and, furthermore, wear of wheel flanges is reduced.

In the present invention, a restoring rod or a horizontal damper being arranged along the vehicle width direction and being retractable in the vehicle width direction is provided in the truck, one end of the restoring rod or the horizontal damper is attached to one of the interlocking lever sections, and the other end of the restoring rod or the horizontal damper is attached to the truck frame. The restoring rod or the horizontal damper allows the first coupling member and the second coupling member to return from a pivoted state during curved track traveling of the vehicle, to a state during linear track traveling of the vehicle. Furthermore, the restoring rod or the horizontal damper can absorb swing of the first coupling member and the second coupling member during the linear track traveling, Occurrence of deflection of the journal member and the wheels involved in such swing can be prevented. Therefore, the effects explained above can be more surely obtained, while traveling stability during the linear track traveling of the vehicle is improved.

In the present invention, an actuator being arranged along the vehicle width direction and being capable of reciprocatingly moving in the vehicle width direction is provided in the truck, one end of the actuator is attached to one of the interlocking lever sections of the first coupling member and the second coupling member, and the other end of the actuator is attached to the truck frame, so that the actuator can control the pivotal movement of the first coupling member and the second coupling member. Therefore, for example, the actuator operates to correspond to the curved track, so that the wheels linked to the first coupling member and the second coupling member, can more surely enter a curved track at a small attack angle.

BRIEF DESCRIPTION OF DRAWINGS

FIG. 3(*b*) is a longitudinal sectional view showing a schematic structure of a rubber-type restoring rod.

DESCRIPTION OF EMBODIMENTS

First Embodiment

Figure 1:
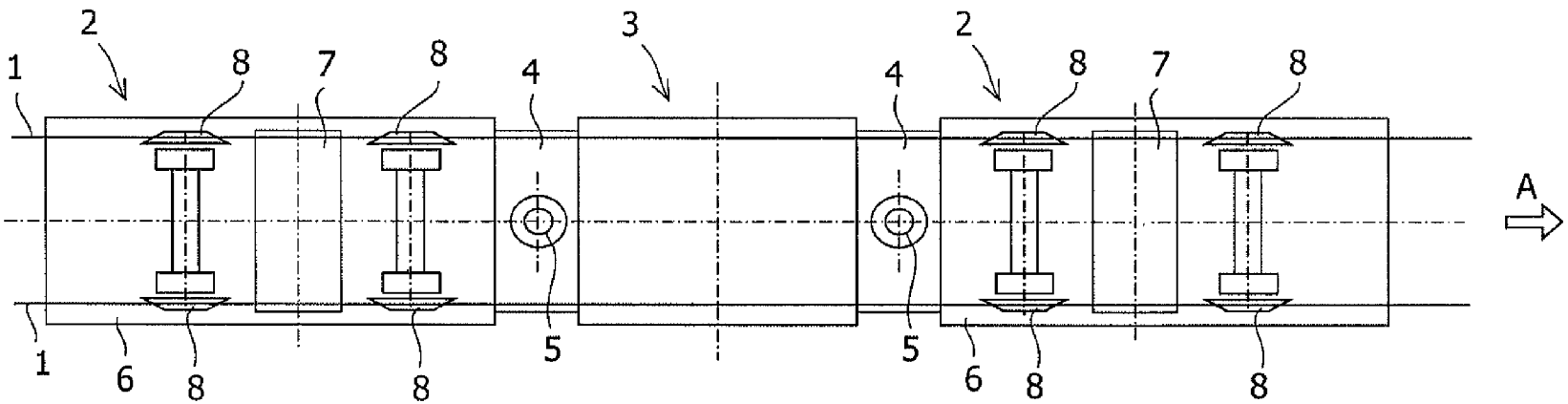
FIG. 1 is an explanatory diagram showing a low floor vehicle during linear track traveling in a first embodiment of the present invention.

A low floor vehicle (hereinafter referred to as "vehicle") in a first embodiment of the present invention, is explained below. In the first embodiment, as an example of the vehicle, the vehicle is explained by using an LRV as shown in FIG. 1. In the explanation, it is assumed that a traveling direction of the vehicle is a vehicle front. FIG. 1 is a diagram of the vehicle viewed from above. The traveling direction of the vehicle is indicated by the arrow A. The vehicle shown in FIG. 1 includes two front vehicles 2 and one intermediate vehicle 3 which travel on a track 1. As a vehicle composition, the one intermediate vehicle 3 is arranged between the two front vehicles 2. Connecting sections 4 are arranged between the front vehicles 2 and the intermediate vehicle 3. Pin connectors 5 are provided in the connecting sections 4 along an axis which extends in a vehicle vertical direction. The front vehicles 2 are coupled to the intermediate vehicle 3 so as to be capable of turning around the pin connectors 5. Trucks 7 are arranged under vehicle bodies 6 of the front vehicles 2. Wheels 8 provided in the trucks 7, travel on the track 1.

The structure of the truck 7 is explained with reference to the truck 7 in a state during linear traveling shown in FIG. 2. A traveling direction of the vehicle is indicated by the arrow A. In the truck 7, a truck frame 9 is provided as a frame member of the truck 7. The vehicle body 6 (shown in FIG. 1) is supported by this truck frame 9. Two truck frame lateral beams 9*a* extending in a vehicle width direction, are disposed in this truck frame 9 spaced apart from each other in a vehicle longitudinal direction. Furthermore, in the truck frame 9, two truck frame longitudinal beams 9*b* extending in the vehicle longitudinal direction, respectively cross the two truck frame lateral beams 9*a*, and are disposed spaced apart from each other in the vehicle width direction.

Journal members 10 are respectively provided at the front end and the rear end of the truck frame longitudinal beams 9*b*. Therefore, the truck frame lateral beams 9*a* are located closer to the center in the vehicle longitudinal direction than the journal members 10. A pair of wheels 8 is attached at both ends in the vehicle width direction of each of the journal members 10 so as to be pivotable independently from each other about the same axis 8*a*. Wheel flanges 8*b* are provided at edges on the inner side in the vehicle width direction of the wheels 8. The journal member 10 extends near the road surface between both ends to which the wheels 8 are attached. Conical rubbers 11 are disposed as shaft springs of the wheels 8 between the truck frame longitudinal beams 9*b* and the ends of the journal member 10. The ends of the journal members 10 are attached to the truck frame longitudinal beams 9*b* via the conical rubbers 11. The conical rubbers 11 are configured to absorb vibration applied from a vehicle vertical direction from the wheels 8, and are configured to enable the journal members 10 to turn with respect to the truck frame 9.

Coupling members 12 which couple the truck frame lateral beams 9*a* and the journal members 10 are respectively disposed in the vehicle front side and the vehicle rear side of the truck 7. The coupling members 12 are formed to widen in the vehicle width direction from the truck frame lateral beams 9*a* toward the journal members 10, and are attached by spherical bushes in the centers in the vehicle width direction of the truck frame lateral beams 9*a*.

Stopper members 13 are provided in the truck frame lateral beams 9*a*. The stopper members 13 are arranged spaced apart from edges on the outer sides in the vehicle width direction of the coupling members 12 such that pivotal movement on the outer sides in the vehicle width direction of the coupling members 12 is regulated to a fixed amount. In the stopper members 13, stopper rubbers 13*a* are provided in sections in contact with the coupling members 12. Impact during contact of the coupling members 12 and the stopper members 13 can be relaxed.

First restoring rods 14 are respectively provided on the outer sides on the left and right in the vehicle width direction of the coupling members 12. As another example, horizontal dampers may be provided instead of the first restoring rods 14. The first restoring rods 14 are arranged in the vehicle longitudinal direction on the outer sides in the vehicle width direction of the stopper members 13, and are configured to be retractable in the vehicle longitudinal direction. One ends of the first restoring rods 14 are attached to the journal members 10 so as to be pivotable around an axis which extends in the vehicle vertical direction. The other ends of the first restoring rods 14 are attached to the truck frame lateral beams 9*a* so as to be pivotable around the axis extending in the vehicle vertical direction.

Figure 3:
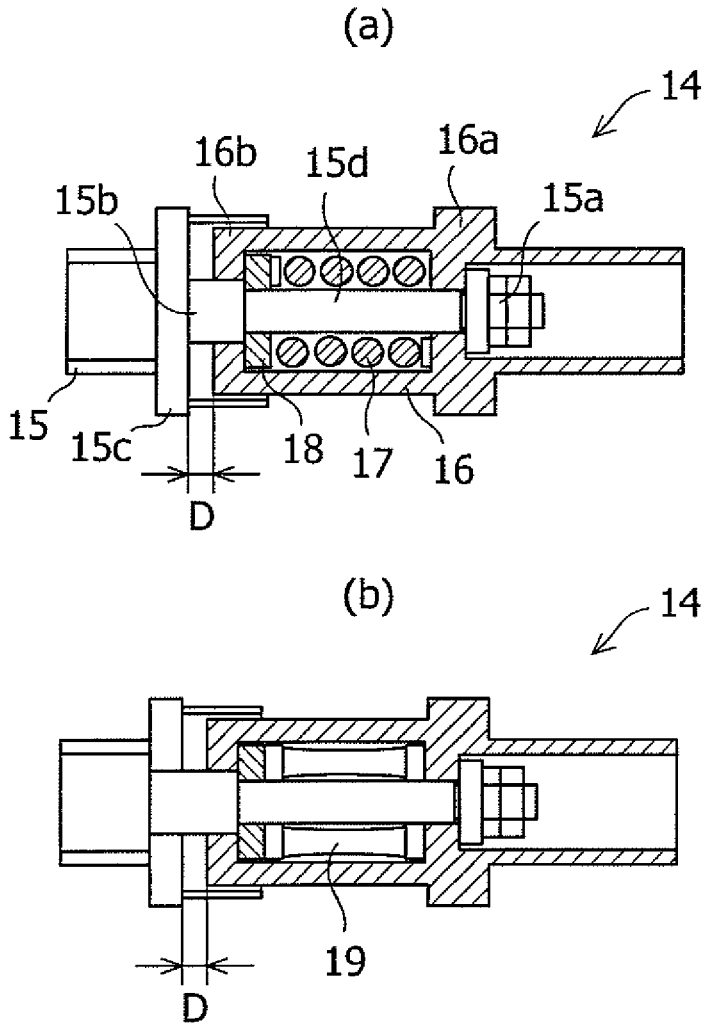
FIG. 3(*a*) is a longitudinal sectional view showing a schematic structure of a spring-type restoring rod in the vehicle in the first embodiment of the present invention.

An example of the structure of the first restoring rod 14 is explained with reference to FIG. 3(*a*). In FIG. 3(*a*), the first restoring rod 14 is in a free supported state. The first restoring rod 14 includes a piston rod 15 extending along a longitudinal direction of the first restoring rod 14, and a cylindrical cylinder 16 extending along the longitudinal direction. A head section 15*a* is provided at the distal end of the piston rod 15. A cap section 15*b* is provided at the proximal end of the piston rod 15. A stopper section 15*c* is provided in the cap section 15*b*. A rod section 15*d* is provided between the head section 15*a* and the cap section 15*b*.

Both ends 16*a* and 16*b* in the longitudinal direction of the cylinder 16 are formed so as to be closed. A through hole corresponding to the rod section 15*b* of the piston rod 15 is provided at the end 16*a* on the head section 15*a* side of the piston rod 15. A through hole corresponding to the cap section 15*b* is provided at the end 16*b* on the cap section 15*b* side of the piston rod 15. Therefore, the cap section 15*b* and the rod section 15*d* of the piston rod 15 are movable in the longitudinal direction in the cylinder 16. The head section 15*a* of the piston rod 15 and the end 16*a* of the cylinder 16 of the head section 15*a* side are in contact with each other and regulate the piston rod 15 from moving in the longitudinal direction toward the cap section 15*b* side. On the other hand, the stopper section 15*c* of the piston rod 15 and the end 16*b* of the cylinder 16 located on the cap section 15*b* side are arranged so as to be spaced a distance G apart from each other in the longitudinal direction. The piston rod 15 is movable by the distance G at the maximum in the longitudinal direction toward the head section 15*a* side.

Furthermore, a coil spring 17 is disposed in the cylinder 16 along the longitudinal direction. A guide washer 18 is disposed between this coil spring 17 and the end 16*b* of the cylinder 16 which is located on the cap 15*b* side. This guide washer 18 is in contact with the cap section 15*b* of the piston rod 15. When the cap section 15*b* moves in the longitudinal direction toward the head section 15*a* side, the guide washer 18 moves together with the cap section 15*b*, and the coil spring 17 is compressed.

Regarding the structure of the first restoring rod 14, as another example, a rubber member 19 may be provided instead of the coil spring 17 as shown in FIG. 3(*b*).

Figure 2:
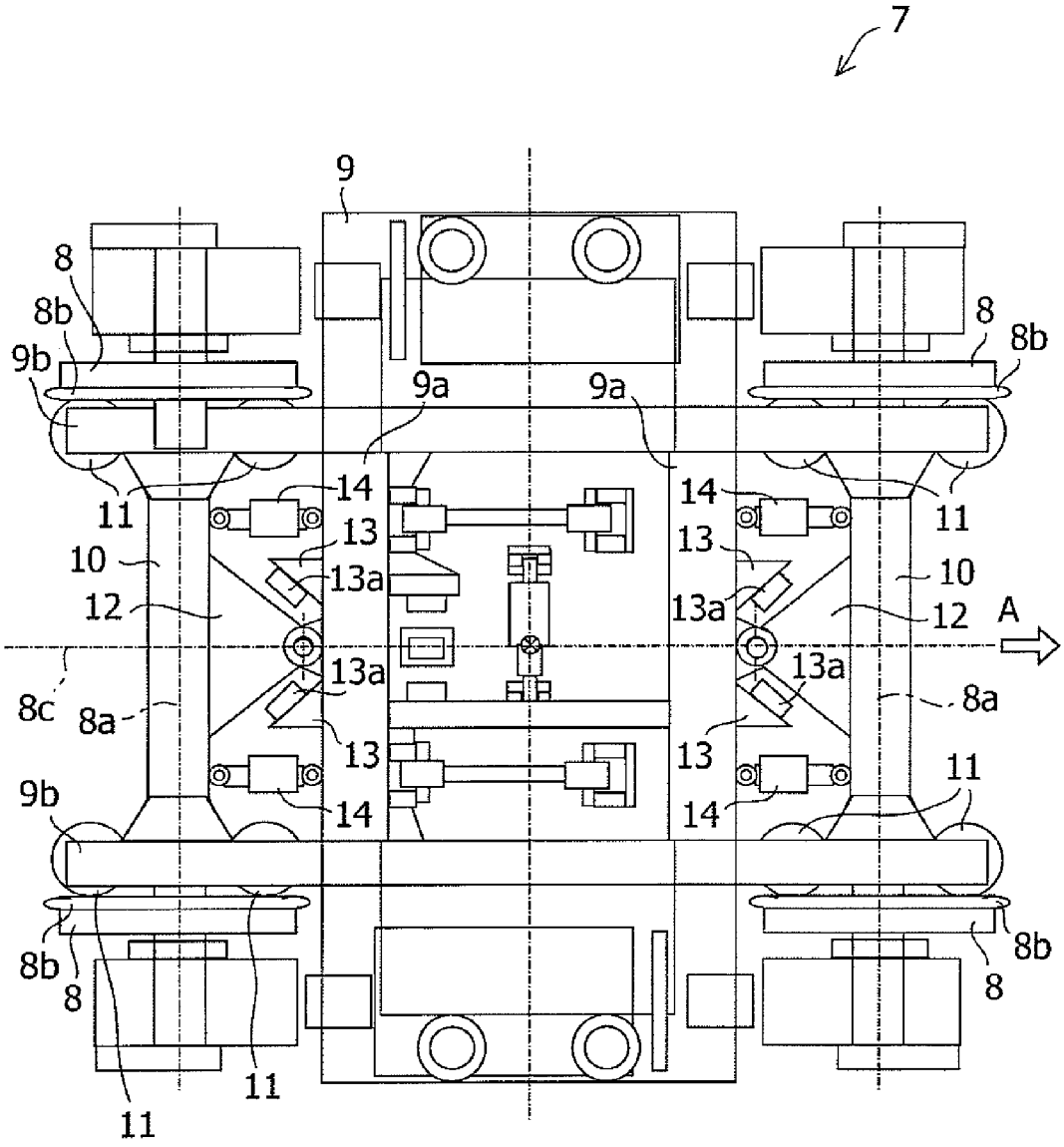
FIG. 2 is a plan view showing a truck of the vehicle in the first embodiment of the present invention.

Regarding the first restoring rod 14 configured in this way, in FIG. 2, the cap section 15*b* of the piston rod 15 is arranged in a state in which the cap section 15*b* moves to the head section 15*a* side. Such a state is a neutral state of the first restoring rod 14. At this point, since the coil spring 17 is in a compressed state, predetermined pressure is applied to the first restoring rod 14. With such a configuration, even in a narrow space between the journal member 10 and the truck frame lateral beam 9*a*, the first restoring rod 14 retractable in the vehicle longitudinal direction, can be provided. The structure of the first restoring rod 14 shown in FIGS. 3(*a*) and 3(*b*) is only an example. The structure may be other structures as long as the first restoring rod 14 can extend and retract.

Figure 4:
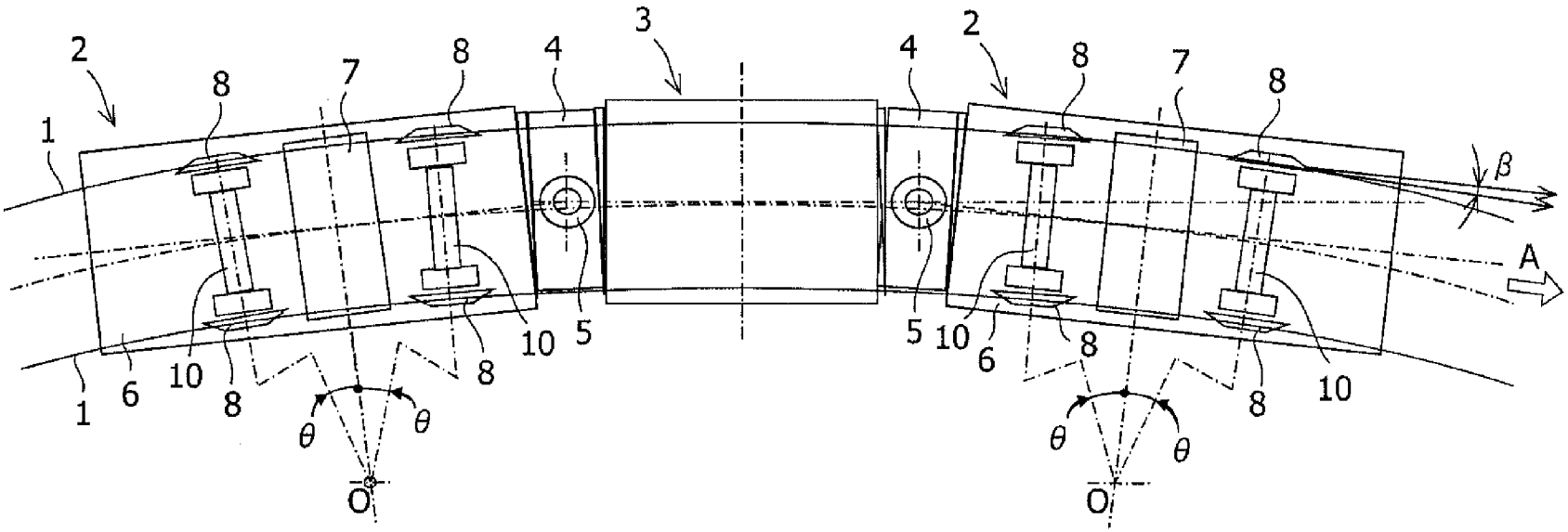
FIG. 4 is an explanatory diagram showing the low floor vehicle during curved track traveling in the first embodiment of the present invention.

Regarding such a vehicle in the first embodiment, an operation in traveling a curved track is explained with reference to FIGS. 2 and 4. FIG. 4 is a diagram of the vehicle viewed from above. A traveling direction of the vehicle is indicated by the arrow A.

When the front vehicle 2 on the vehicle front side enters the curved track, first, the pair of wheels 8 on the vehicle front side enters the curved track, and the wheel flange 8*b* of the wheel 8 on an outside rail side of the curved track, come into contact with the track 1. At this point, force directed to the inner side in the vehicle width direction is applied to the journal member 10 from the wheel flange 8*b*. Therefore, the journal member 10 turns around an attaching section of the journal member 10 and the coupling member 12, the wheel 8 on the outside rail side moves to the vehicle front side, and the wheel 8 on an inside rail side moves to the vehicle rear side. Therefore, the pair of wheels 8 on the vehicle front side turns toward the vehicle front side by an angle θ with reference to a center O of a curvature radius R of the curved track.

Subsequently, the pair of wheels 8 on the vehicle rear side enters the curved track, and the wheel flange 8*b* of the wheel 8 on the outside rail side of the curved track, comes into contact with the track 1. At this point, force directed to the inner side in the vehicle width direction from the wheel flange 8*b*, is applied to the journal member 10. Therefore, the journal member 10 turns around an attaching section of the coupling member 12 and the truck frame lateral beam 9*a*, the wheel 8 on the outside rail side moves to the vehicle rear side, and the wheel 8 on an inside rail side moves to the vehicle front side. Therefore, the pair of wheels 8 on the vehicle rear side turns toward the vehicle rear side by the angle θ with reference to the center O of the curvature radius R of the curved track. As a result, the middle point 14 of the truck frame 9 passes the center between the pair of tracks 1.

When large force is applied to the journal member 10 from the wheel flange 8*b*, the journal member 10 turns, and the wheel 8 is about to move by a degree equal to or greater than a fixed amount which destabilizes traveling of the vehicle, so that the coupling members 12 attached to the journal member 10, come into contact with the stopper rubbers 13*a* of the stopper members 13.

As explained above, with the vehicle in the first embodiment of the present invention, in the truck 7 of the front vehicle 2, the journal member 10 turns around the attaching section of the coupling member 12 and the truck frame lateral beam 9*a*. The pair of wheels 8 on each of the vehicle front side and the vehicle rear side turns together with the journal member 10, and each of the pair of wheels 8 travels along the curved track at a small attack angle β. Therefore, contact pressure between the wheel 8 on the outside rail side and the track 1 is relaxed, lateral pressure on the vehicle is reduced, and occurrence of vibration and creaking sounds of the vehicle are prevented. Therefore, riding comfort for passengers is improved and wear of the wheel flange 8*b* is reduced.

With the vehicle in the first embodiment of the present invention, the first restoring rod 14 allows the journal member 10 to return from a pivoted state during curved track traveling of the vehicle, to a state during linear track traveling of the vehicle. Furthermore, the first restoring rod 14 can absorb swing of the journal member 10 during the linear track traveling. It is possible to prevent occurrence of deflection of the wheels 8 involved in such swing. Therefore, it is possible to improve traveling stability during the linear track traveling of the vehicle.

With the vehicle in the first embodiment of the present invention, a pivoting amount of the coupling member 12 is limited by the stopper member 13. As a result, a turning amount of the journal member 10 and a moving amount of the wheels 8 are restricted. Therefore, it is possible to prevent large movement of the wheels 8, and to secure traveling stability of the vehicle.

Second Embodiment

A vehicle in a second embodiment of the present invention is explained below. In the second embodiment, as in the first embodiment, the vehicle is explained by using an LRV as an example of the vehicle. A basic configuration of the vehicle in the second embodiment is the same as the configuration of the vehicle in the first embodiment. Components the same as those in the first embodiment, are explained by using reference numerals and names which are same as those in the first embodiment. Components different from those in the first embodiment are explained. In the explanation of the second embodiment, it is assumed that a traveling direction of the vehicle is a vehicle front.

Figure 5:
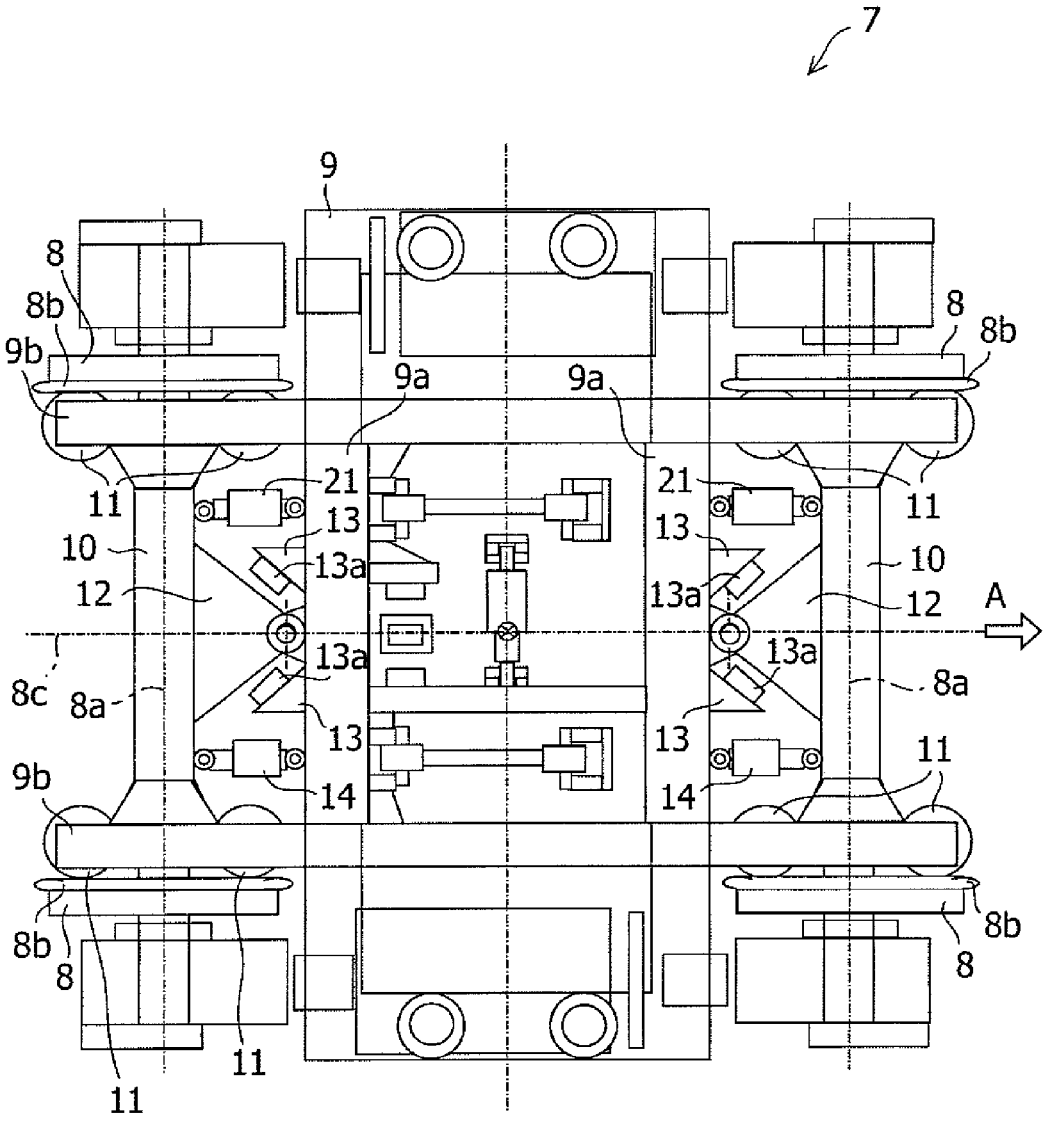
FIG. 5 is a plan view showing a truck of a vehicle in a second embodiment of the present invention.

The structure of the truck 7 in the second embodiment is explained with reference to the truck 7 in a linear traveling time state shown in FIG. 5. In FIG. 5, as an example, unlike in the first embodiment, an actuator 21 is provided instead of one of the pair of first restoring rods 14 which is provided on each of the vehicle front side and the vehicle rear side. As another example, both the pair of first restoring rods 14 may be replaced with actuators 21. Such actuators 21 are arranged along the vehicle longitudinal direction, and are configured to be capable of reciprocatingly move in the vehicle longitudinal direction. One ends of the actuators 21 are attached to the journal member 10 so as to be pivotable around axes extending in the vehicle vertical direction. The other ends of the actuators 21 are attached to the truck frame lateral beam 9*a* so as to be pivotable around the axes extending in the vehicle vertical direction. In FIG. 5, the actuators 21 are in a neutral state.

Figure 6:
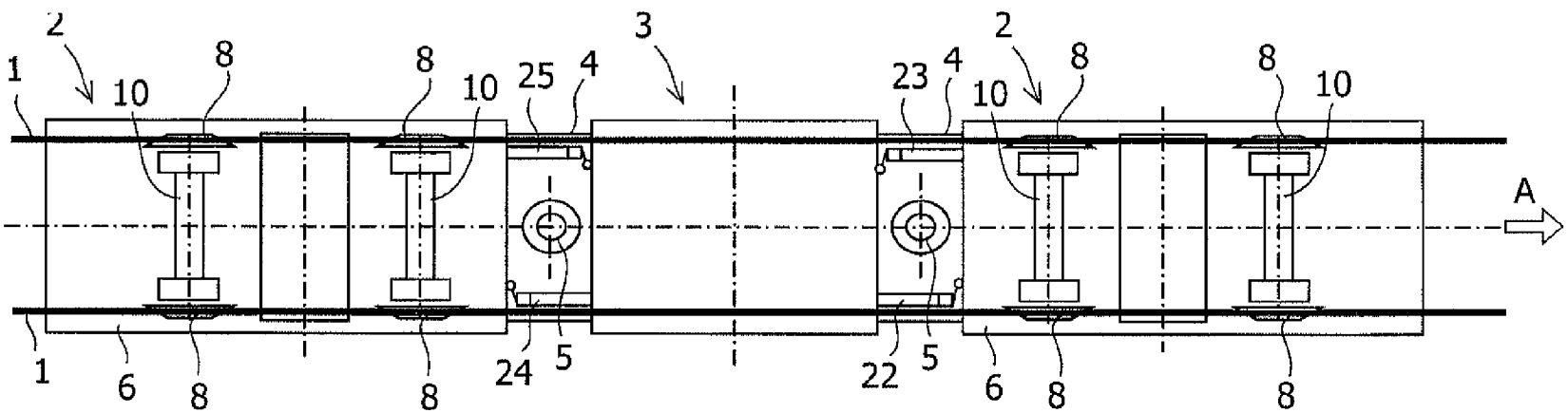
FIG. 6 is an explanatory diagram showing a low floor vehicle during linear track traveling of the vehicle in the second embodiment of the present invention.

In order to control the operation of the actuators 21, as shown in FIG. 6, plural switches are provided in the vehicle. FIG. 6 is a diagram of the vehicle viewed from above. The traveling direction of the vehicle is indicated by the arrow A. In the second embodiment, as an example, four switches 22, 23, 24 and 25 are used.

The first switch 22 corresponding to the track 1 on the traveling direction right side, and the second switch 23 corresponding to the track 1 on the traveling direction left side, are set in the connecting section 4 between the front vehicle 2 on the vehicle front side and the intermediate vehicle 3. The actuators 21 in the front vehicle 2 on the vehicle front side are configured to be controlled by the first switch 22 and the second switch 23. The third switch 24 corresponding to the track 1 on the traveling direction right side, and the fourth switch 25 corresponding to the track 1 on the traveling direction left side, are set. The actuators 21 in the front vehicle 2 on the vehicle rear side are configured to be controlled by the third switch 24 and the fourth switch 25.

Switching of the first to fourth switches 22, 23, 24 and 25 during curved track passage of the vehicle, and an operation state of the actuators 21 involved in this switching, are explained. In the fourth embodiment of the present invention, as an example, in the first to fourth switches 22, 23, 24 and 25, a switch located on the inside rail side of the curved track, is configured to be turned on when the curvature radius R of the curved track on which the vehicle passes is equal to or less than R100.

When the vehicle passes on a linear track as shown in FIG. 6, all the first to fourth switches 22, 23, 24, and 25 are off. At this point, the actuators 21 are in the neutral state without operating.

Figure 7:
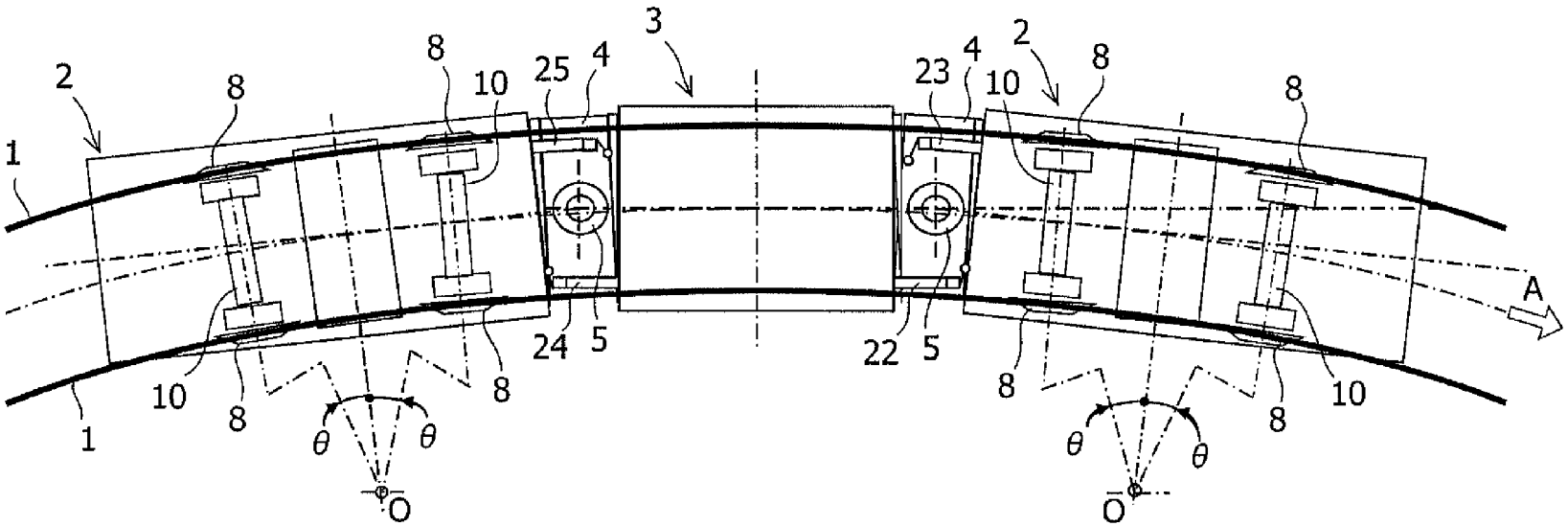
FIG. 7 is an explanatory diagram showing the low floor vehicle during right-curved track traveling in the second embodiment of the present invention.

The switching of the first to fourth switches 22, 23, 24 and 25, and the operation state of the actuators 21 in the case in which the vehicle passes on a right-curved track curving to the traveling direction right side, are explained by using FIG. 7. FIG. 7 is a diagram of the vehicle viewed from above. The traveling direction of the vehicle is indicated by the arrow A. In FIG. 7, the first switch 22 and the third switch 24 on the inside rail side of the right-curved track, are on, and the second switch 23 and the fourth switch 25 on the outside rail side of the right-curved track, are off. At this point, in the front vehicles 2 on the vehicle front side and the vehicle rear side, the actuators 21 respectively perform an expansion operation.

Therefore, the journal member 10 on the vehicle front side turns to the right such that the wheel 8 on the traveling direction right side is moved to the vehicle rear side and the wheel 8 on the traveling direction left side is moved to the vehicle front side. On the other hand, the journal member 10 on the vehicle rear side turns to the left such that the wheel 8 on the traveling direction right side is turned to the vehicle front side and the wheel 8 on the traveling direction left side is turned to the vehicle rear side. At this point, the pair of wheels 8 on the vehicle front side turns toward the vehicle front side by the angle θ with reference to the center O of the curvature radius R of the right-curved track. The pair of wheels 8 on the vehicle rear side turns toward the vehicle rear side by the angle θ with reference to the center O of the curvature radius R of the right-curved track.

Figure 8:
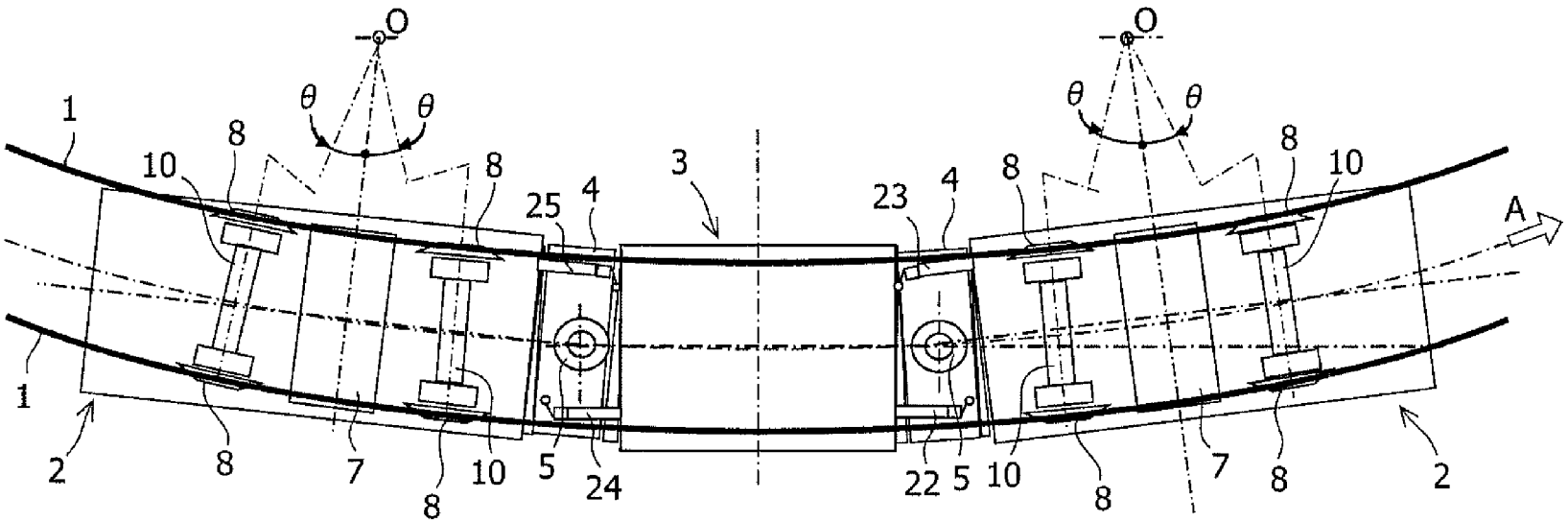
FIG. 8 is an explanatory diagram showing the low floor vehicle during left-curved track traveling in the second embodiment of the present invention.

The switching of the first to fourth switches 22, 23, 24 and 25, and the operation state of the actuators 21 in the case in which the vehicle passes on a left-curved track curving to the traveling direction left side, are explained by using FIG. 8. FIG. 8 is a diagram of the vehicle viewed from above. The traveling direction of the vehicle is indicated by the arrow A. In FIG. 8, the second switch 23 and the fourth switch 25 on the inside rail side of the left-curved track, are on, and the first switch 22 and the third switch 24 on the outside rail side of the left-curved track, are off. At this point, in the front vehicles 2 on the vehicle front side and the vehicle rear side, the actuators 21 respectively perform a contraction operation.

Therefore, the journal member 10 on the vehicle front side turns to the left such that the wheel 8 on the traveling direction right side is moved to the vehicle front side and the wheel 8 on the traveling direction left side is moved to the vehicle rear side. On the other hand, the journal member 10 on the vehicle rear side turns to the right such that the wheel 8 on the traveling direction right side is moved to the vehicle rear side and the wheel 8 on the traveling direction left side is moved to the vehicle front side. At this point, the pair of wheels 8 and the journal member 10 on the vehicle front side turn toward the vehicle front side by the angle θ with reference to the center O of the curvature radius R of the left-curved track. The pair of wheels 8 and the journal member 10 on the vehicle rear side turn toward the vehicle rear side by the angle θ with reference to the center O of the curvature radius R of the left-curved track.

A control flow of the actuators 21 involved in the switching of the first to fourth switches 22, 23, 24 and 25 during the curved track passage of the vehicle is explained with reference to FIGS. 9 and 10.

The control flow in the case in which the vehicle passes on the right-curved track curving to the traveling direction right side is explained.

Figure 9:
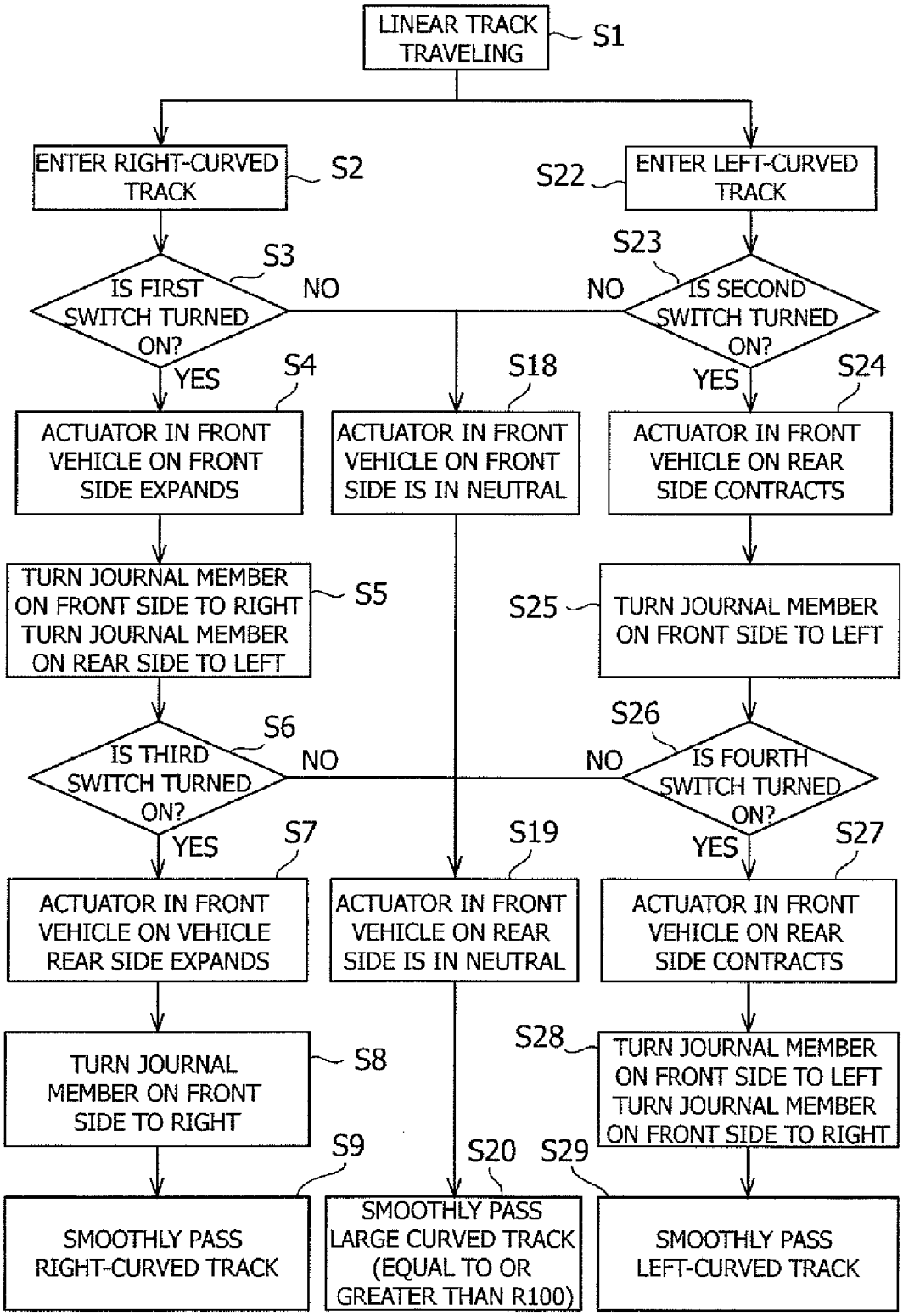
FIG. 9 is a control flow of an actuator of the vehicle that passes on a curved track in the second embodiment of the present invention.

Referring to FIG. 9, from a state in which the front vehicle 2 on the vehicle front side is traveling on the linear track (S1), when the vehicle enters the right-curved track (S2), if the curvature radius R of the curved track is equal to or less than R100, the first switch 22 is turned on and, if the curvature radius R of the curved track is equal to or greater than R100, the first switch 22 is kept off (S3). If the curvature radius R of the curved track is equal to or less than R100 and the first switch 22 is turned on (S3), the actuators 21 on the vehicle front side and the vehicle rear side perform the expansion operation in the front vehicle 2 on the vehicle front side (S4), the journal member 10 on the vehicle front side turns to the right, and the journal member 10 on the vehicle rear side turns to the left (S5).

Furthermore, when the front vehicle 2 on the vehicle rear side enters the right-curved track, if the curvature radius R of the curved track is equal to or less than R100, the third switch 24 is turned on and, if the curvature radius R of the curved track is equal to or greater than R100, the third switch 24 is kept off (S6). If the curvature radius R of the curved track is equal to or less than R100 and the third switch 24 is turned on (S6), the actuators 21 perform the expansion operation in the front vehicle 2 on the vehicle rear side (S7), the journal member 10 on the vehicle front side turns to the right, and the journal member 10 on the vehicle rear side turns to the left (S8). As a result, the vehicle smoothly passes on the right-curved track having the curvature radius equal to or less than R100 (S9).

Figure 10:
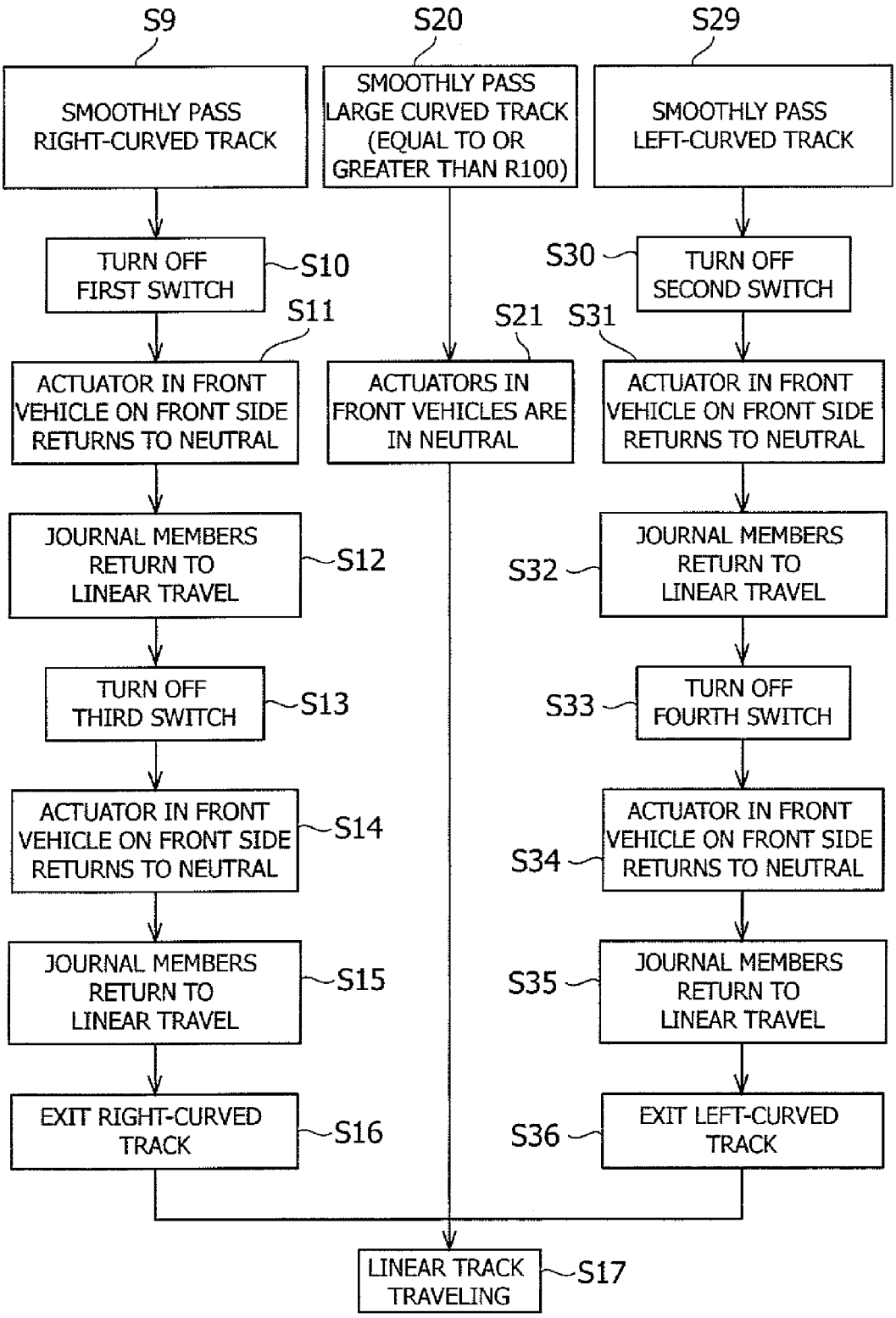
FIG. 10 is a control flow of the actuator of the vehicle that exits the curved track in the second embodiment of the present invention.

Referring to FIG. 10, after the vehicle smoothly travels on the right-curved track having the curvature radius equal to or less than R100 (S9), the first switch 22 is turned off (S10), the actuators 21 on the vehicle front side and the vehicle rear side return to the neutral state in the front vehicle 2 on the vehicle front side (S11), and the journal members 10 on the vehicle front side and the vehicle rear side return to the state during the linear track traveling (S12).

Furthermore, the third switch 24 is turned off (S13), the actuators 21 on the vehicle front side and the vehicle rear side return to the neutral state in the front vehicle 2 on the vehicle rear side (S 14), and the journal members 10 on the vehicle front side and the vehicle rear side return to the state during the linear track traveling (S15). As a result, the vehicle smoothly exits the right-curved track having the curvature radius equal to or less than R100 (S16) and travels on the linear track again (S17).

On the other hand, referring to FIG. 9, if the curvature radius R of the curved track is equal to or greater than R100 and the first switch 22 is kept off (S3), the actuators 21 on the vehicle front side and the vehicle rear side maintain the neutral state in the front vehicle 2 on the vehicle front side (S18). If the curvature radius R of the curved track is equal to or greater than R100 and the third switch 24 is kept off (S6), the actuators 21 on the vehicle front side and the vehicle rear side maintain the neutral state in the front vehicle 2 on the vehicle rear side (S19). As a result, the vehicle smoothly passes on the right-curved track having the curvature radius equal to or greater than R100 (S20).

Referring to FIG. 10, even after the vehicle smoothly passes on the right-curved track having the curvature radius equal to or greater than R100 (S20), the actuators 21 on the vehicle front side and the vehicle rear side maintain the neutral state in the front vehicles 2 on the vehicle front side and the vehicle rear side (S21). As a result, the vehicle smoothly exits the right-curved track having the curvature radius equal to or greater than R100, and travels on the linear track again (S17).

The control flow in the case in which the vehicle passes on the left-curved track curving to the traveling direction left side is explained.

Referring to FIG. 9, from a state in which the front vehicle 2 on the vehicle front side is traveling on the linear track (S1), when the vehicle enters the left-curved track (S22), if the curvature radius R of the curved track is equal to or less than R100, the second switch 23 is turned on and, if the curvature radius R of the curved track is equal to or greater than R100, the second switch 23 is kept off (S23). If the curvature radius R of the curved track is equal to or less than R100 and the second switch 23 is turned on (S23), the actuators 21 on the vehicle front side and the vehicle rear side perform the contraction operation in the front vehicle 2 on the vehicle front side (S24), the journal member 10 on the vehicle front side turns to the left, and the journal member 10 on the vehicle rear side turns to the right (S25).

Furthermore, when the front vehicle 2 on the vehicle rear side enters the left-curved track, if the curvature radius R of the curved track is equal to or less than R100, the fourth switch 25 is turned on and, if the curvature radius R of the curved track is equal to or greater than R100, the fourth switch 25 is kept off (S26). If the curvature radius R of the curved track is equal to or less than R100 and the fourth switch 25 is turned on (S26), the actuators 21 on the vehicle front side and the vehicle rear side perform the contraction operation in the front vehicle 2 on the vehicle rear side (S27), the journal member 10 on the vehicle front side turns to the left, and the journal member 10 on the vehicle rear side turns to the right (S28). As a result, the vehicle smoothly travels on the left-curved track having the curvature radius equal to or less than R100 (S29).

Referring to FIG. 10, after the vehicle smoothly travels on the left-curved track having the curvature radius equal to or less than R100 (S29), the second switch 23 is turned off (S30), the actuators 21 on the vehicle front side and the vehicle rear side return to the neutral state in the front vehicle 2 on the vehicle front side (S31), and the journal members 10 on the vehicle front side and the vehicle rear side return to the state during the linear track traveling (S32).

Furthermore, the fourth switch 25 is turned off (S33), the actuators 21 on the vehicle front side and the vehicle rear side return to the neutral state in the front vehicle 2 on the vehicle rear side (S34), and the journal members 10 on the vehicle front side and the vehicle rear side return to the state during the linear track traveling (S35). As a result, the vehicle smoothly exits the left-curved track having the curvature radius equal to or less than R100 (S36) and travels on the linear track again (S17).

On the other hand, referring to FIG. 9, if the curvature radius R of the curved track is equal to or greater than R100 and the second switch 23 is kept off (S23), the actuators 21 maintain the neutral state in the front vehicle 2 on the vehicle front side (S18). If the curvature radius R of the curved track is equal to or greater than R100 and the third switch 24 is kept off (S26), the actuators 21 maintain the neutral state in the front vehicle 2 on the vehicle rear side (S19). As a result, the vehicle smoothly passes on the left-curved track having the curvature radius equal to or greater than R100 (S20).

Referring to FIG. 10, even after the vehicle smoothly passes on the left-curved track having the curvature radius equal to or greater than R100 (S20), the actuators 21 on the vehicle front side and the vehicle rear side maintains the neutral state in the front vehicles 2 on the vehicle front side and the vehicle rear side (S21). As a result, the vehicle smoothly exits the left-curved track having the curvature radius equal to or greater than R100 and travels on the linear track again (S17).

As explained above, with the vehicle in the second embodiment of the present invention, the pivotal movement of the journal members 10 can be controlled by the actuators 21. Therefore, for example, the actuators 21 operate so as to correspond to the curved track, and the wheels 8 attached to the journal members 10 can more surely enter the curved track at a small attack angle.

Third Embodiment

A vehicle in a third embodiment of the present invention is explained below. In the third embodiment, as in the first and second embodiments, the vehicle is explained by using a LRV as an example of the vehicle. A basic configuration of the vehicle in the third embodiment is the same as the configuration of the vehicle in the first embodiment. Components the same as those in the third embodiment are explained by using reference numerals and names which are the same as those in the first embodiment. Components different from those in the first embodiment are explained. In the explanation of the third embodiment, it is assumed that a traveling direction of the vehicle is toward the vehicle front.

Figure 11:
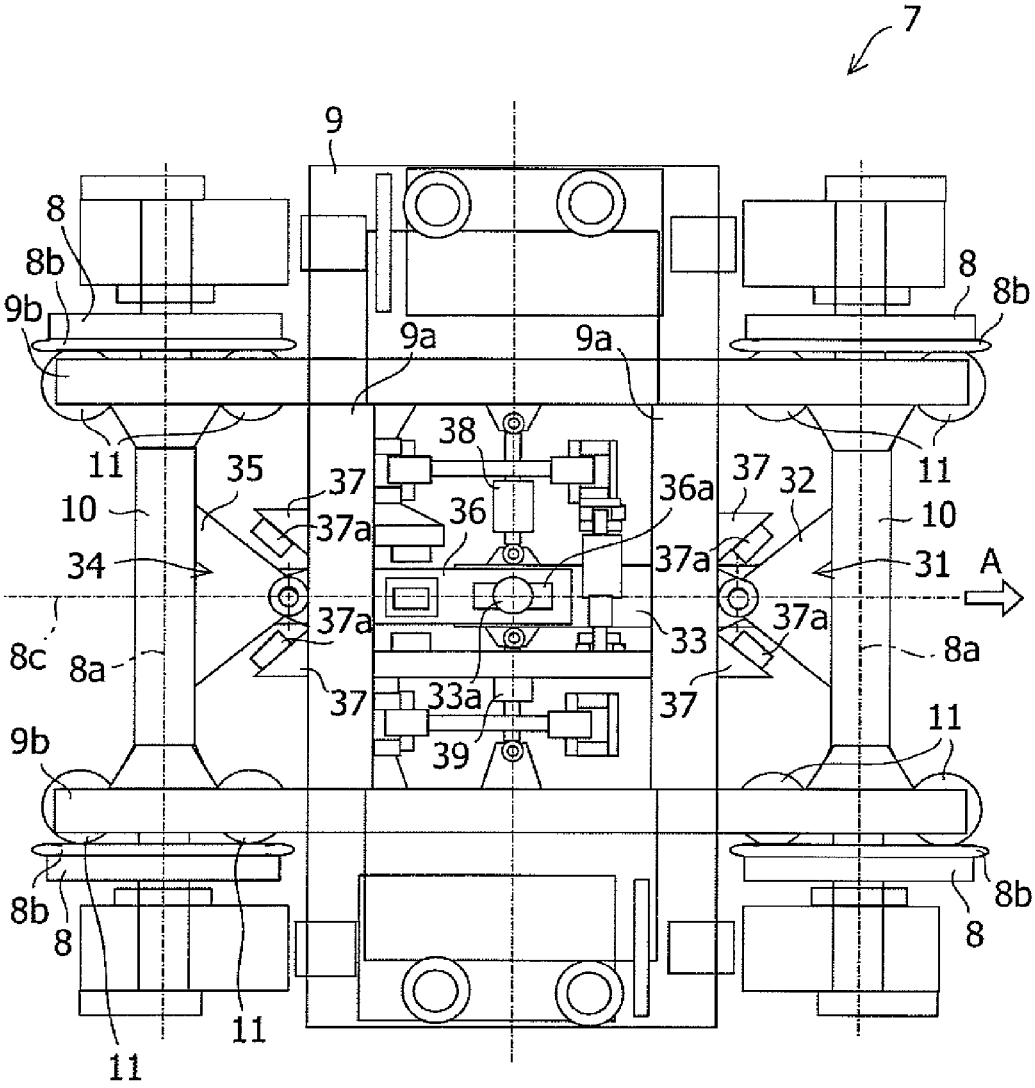
FIG. 11 is a plan view showing a truck of a vehicle in a third embodiment of the present invention.

The structure of the truck 7 in the third embodiment is explained with reference to the truck 7 in a linear traveling time state shown in FIG. 11. In FIG. 11, a traveling direction of the vehicle is indicated by the arrow A. A first coupling member 31 is disposed on the vehicle front side of the truck 7. A coupling section 32 and an interlocking lever section 33 are provided in the first coupling member 31. The coupling section 32 couples the journal member 10 and the truck frame lateral beam 9*a*. The coupling section 32 is formed to widen in the vehicle width direction from the truck frame lateral beam 9*a* toward the journal member 10 and is attached by a spherical bush in the center in the vehicle width direction of the truck frame lateral beam 9*a*.

The interlocking lever section 33 is formed to extend along the vehicle longitudinal direction from the truck frame lateral beam 9*a* on the vehicle front side toward the center of the truck frame 9. A coupling pin 33*a* is provided at the distal end of the interlocking lever section 33. This coupling pin 33*a* is arranged on an axis 8*c* of the vehicle extending in the vehicle width direction in the center between the wheels 8 on the vehicle front side and the vehicle rear side.

A second coupling member 34 is disposed on the vehicle rear side of the truck 7. The second coupling member 34 is arranged to be opposed to the first coupling member 31. A coupling section 35 and an interlocking lever section 36 are provided in the second coupling member 34. The coupling section 35 couples the journal member 10 and the truck frame lateral beam 9*a* on the vehicle rear side. The coupling section 35 is formed to widen in the vehicle width direction from the truck frame lateral beam 9*a* toward the journal member 10, and is attached by a spherical bush in the center in the vehicle width direction of the truck frame lateral beam 9*a*.

The interlocking lever section 36 is formed to extend along the vehicle longitudinal direction from the truck frame lateral beam 9*a* on the vehicle front side to the center of the truck frame 9. A long hole 36*a* is drilled at the distal end of the interlocking lever section 36. The long hole 36*a* is formed to extend in the vehicle longitudinal direction to correspond to the coupling pin 33*a* of the first coupling member 31. The coupling pin 33*a* of the first coupling member 31 engages with the long hole 36*a* of the second coupling member 34. In the linear traveling state, the coupling pin 33*a* is located in the center in the vehicle longitudinal direction of the long hole 36*a*.

A pair of stopper members 37 is provided in each of the truck frame lateral beams 9*a* on the vehicle front side and the vehicle rear side. The stopper members 37 are arranged spaced apart from edges on the outer sides in the vehicle width direction of the coupling section 32 of the first coupling member 31 or the second coupling section 35 of the second coupling member 34 so as to regulate the pivotal movement on the outer sides in the vehicle width direction of the first coupling member 31 or the second coupling member 34. In the stopper members 37, stopper rubbers 37*a* are provided in sections in contact with the coupling section 32 or the coupling section 35. Impact during contact of the first coupling member 31 or the second coupling member 34, and the stopper member 37, can be relieved.

An actuator 38 is provided in the truck 7. The actuator 38 is arranged along the vehicle width direction, and is configured to be capable of reciprocatingly moving in the vehicle width direction. One end of this actuator 38 is attached to one of the interlocking lever sections 33 and 36 in the first coupling member 31 and the second coupling member 34 so as to be pivotable around an axis extending in the vehicle vertical direction. The other end of the actuator 38 is attached to a truck frame longitudinal beam 9*b* on the traveling direction left side so as to be pivotable around the axis extending in the vehicle vertical direction. In FIG. 11, the actuator 38 is in a neutral state.

As an example, a second restoring rod 39 is provided in the truck 7. As another example, a horizontal damper may be provided instead of the second restoring rod 39. The second restoring rod 39 is arranged along the vehicle width direction and is configured to be retractable in the vehicle width direction. One end of the second restoring rod 39 is attached to one of the interlocking lever sections 33 and 36 of the first coupling member 31 and the second coupling member 34 so as to be pivotable around an axis extending in the vehicle vertical direction. The other end of the second restoring rod 39 is attached to the truck frame longitudinal beam 9*b* on the traveling direction right side so as to be pivotable around the axis extending in the vehicle vertical direction.

Figure 12:
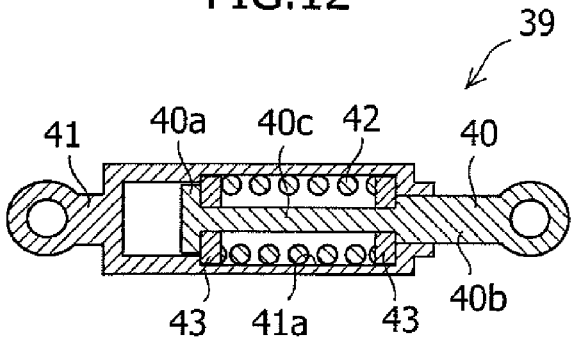
FIG. 12 is a longitudinal sectional view showing a schematic structure of a restoring rod in the vehicle in the third embodiment of the present invention.
Figure 13:
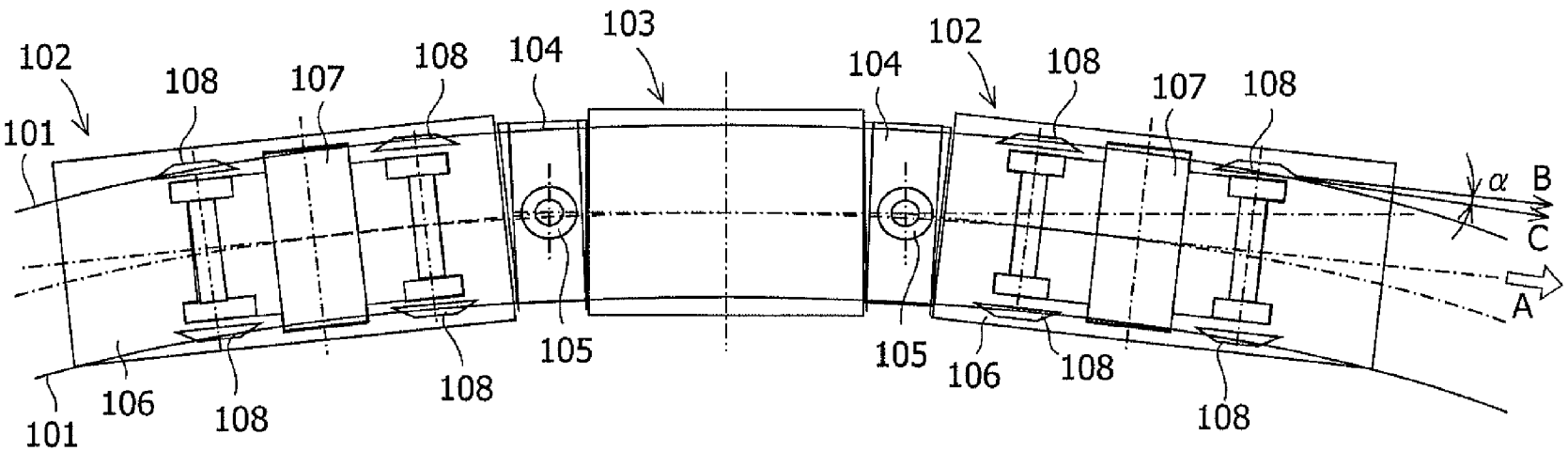
FIG. 13 is an explanatory diagram showing a conventional low floor vehicle during curved track traveling.
Figure 14:
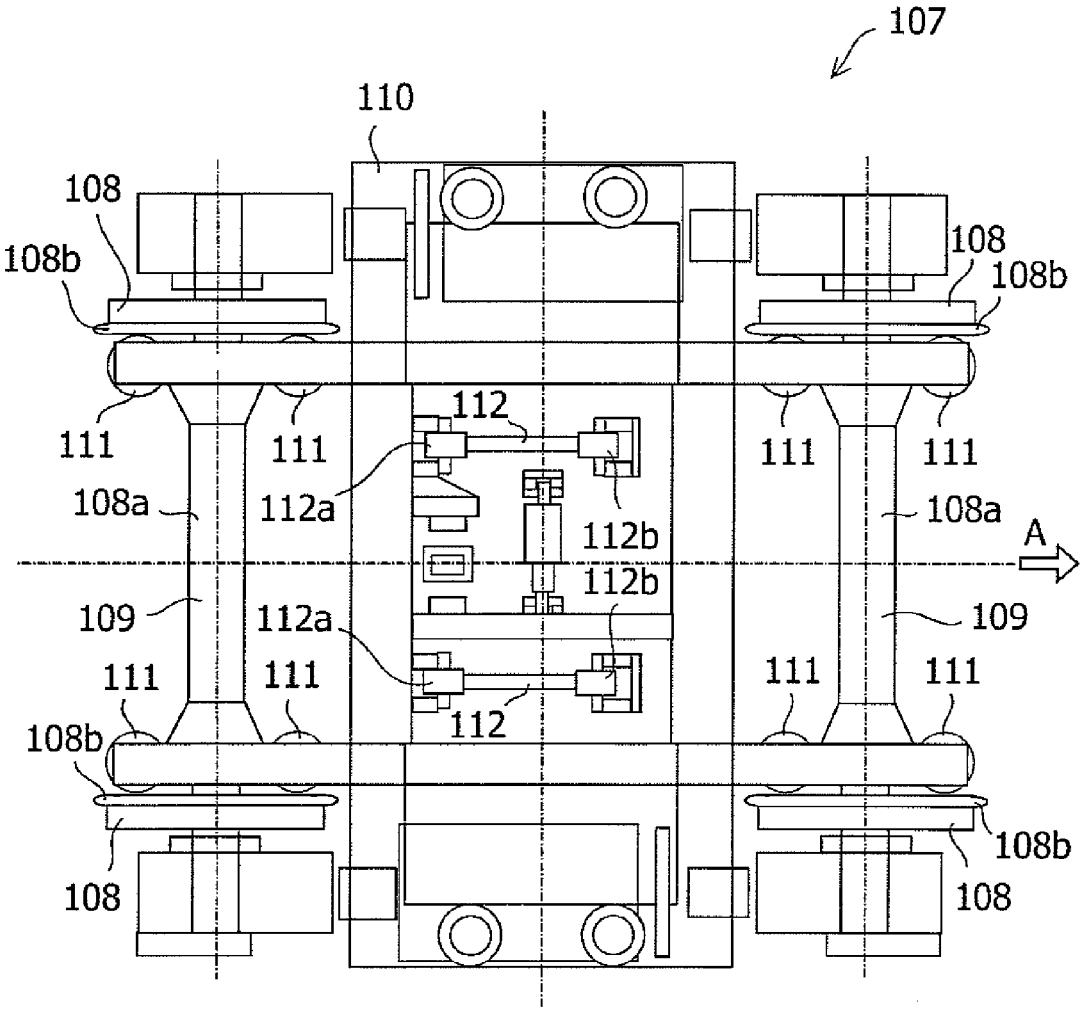
FIG. 14 is a plan view showing a truck of the conventional vehicle.
Figure 15:
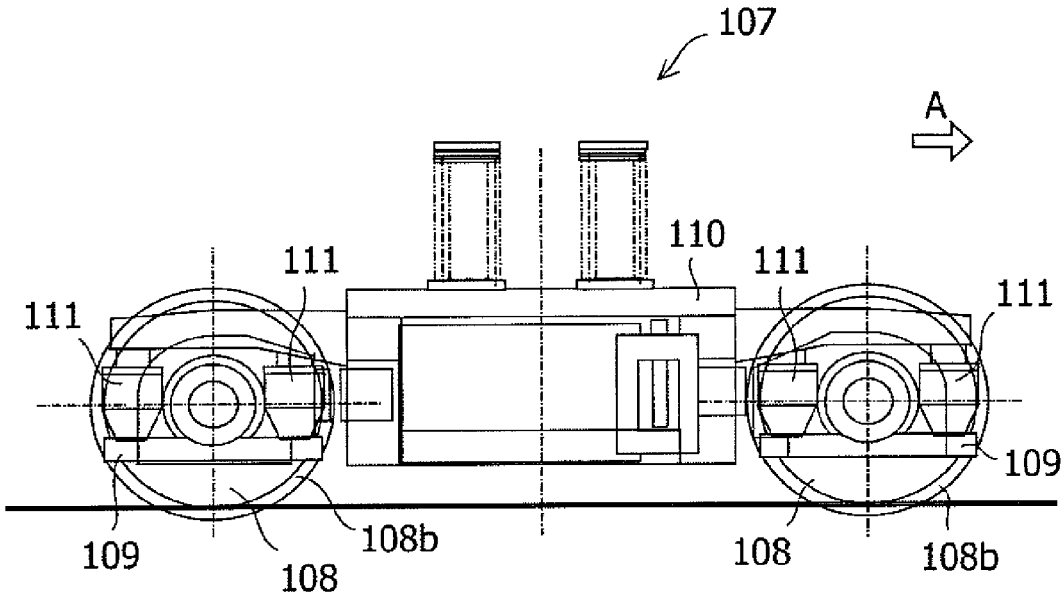
FIG. 15 is a side view showing the truck of the conventional vehicle.
Figure 16:
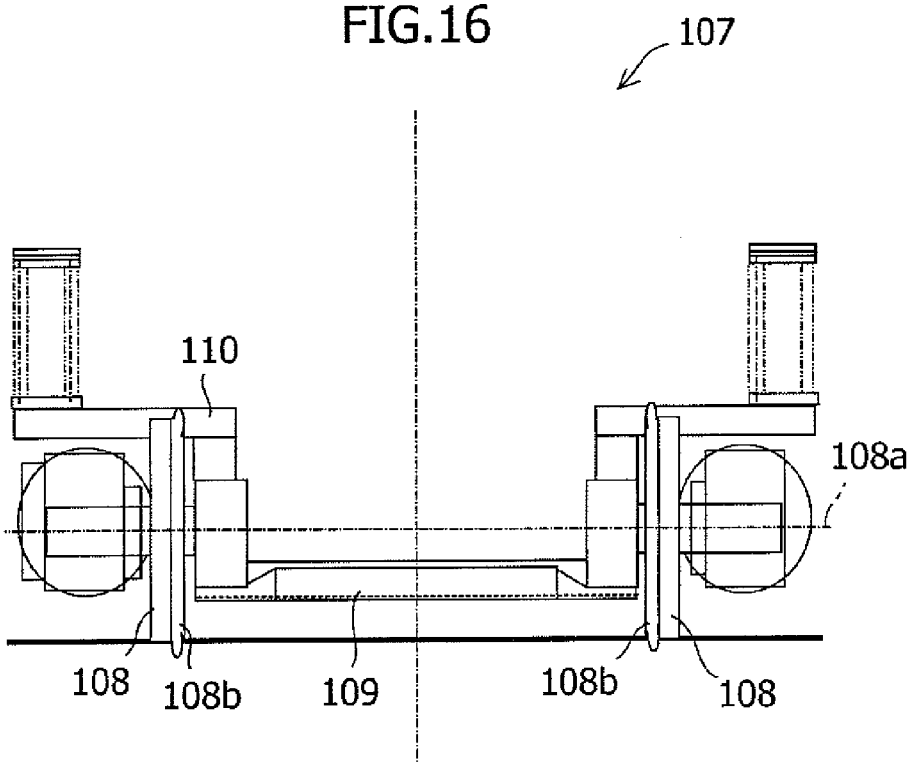
FIG. 16 is a front view showing the truck of the conventional vehicle.

An example of the structure of the second restoring rod 39 is explained with reference to FIG. 12. A piston rod 40 extending along the longitudinal direction of the second restoring rod 39, and a cylindrical cylinder 41 extending along the longitudinal direction, are provided in the second restoring rod 39. A head section 40*a* is provided at the distal end of the piston rod 40. A cap section 40*b* is provided at the proximal end of the piston rod 40. A rod section 40*c* extends between the head section 40*a* and the cap section 40*b*. A coil spring 42 is provided in an internal space of the cylinder 41. A recessed section 41*a* is provided on an inner circumferential wall of the internal space of the cylinder 41 such that the coil spring 42 can be arranged in a compressed state. The coil spring 42 is arranged in this recessed section 41*a*. Furthermore, guide washers 43 are respectively disposed at both ends in the vehicle width direction of the coil spring 42.

The guide washers 43 are pressed against both ends in the vehicle width direction of the recessed section 41*a* by pressure from the coil spring 42 in the compressed state. The rod section 40*c* of the piston rod 40 is arranged to pass through the coil spring 42 and the guide washers 43. One of the head section 40*a* and the cap section 40*b* is configured to compress the coil spring 42 while engaging with the guide washer 43 during movement in the longitudinal direction of the piston rod 40.

Regarding such a vehicle in the third embodiment, an operation in traveling a curved track is explained with reference to FIGS. 4 and 11. When the front vehicle 2 on the vehicle front side, enters the curved track, first, the pair of wheels 8 on the vehicle front side enter the curved track and the wheel flange 8*b* of the wheel 8 on an outside rail side of the curved track, comes into contact with the track 1. At this point, force directed to the inner side in the vehicle width direction is applied to the journal member 10 from the wheel flange 8*b*. Therefore, the journal member 10 turns around an attaching section of the coupling section 32 of the first coupling member 31 and the truck frame lateral beam 9*a*, the wheel 8 on the outside rail side moves to the vehicle front side, and the wheel 8 on an inside rail side moves to the vehicle rear side.

At this point, the first coupling member 31 and the second coupling member 34, pivot in association with each other according to engagement of the coupling pin 33*a* of the first coupling member 31 and the long hole 36*a* of the second coupling member 34. Therefore, the journal member 10 on the vehicle rear side turns in the opposite direction of the pivoting direction of the journal member 10 on the vehicle front side. In the journal member 10 on the vehicle rear side, the wheel 8 on the outside rail side moves to the vehicle rear side, and the wheel 8 on the inside rail side moves to the vehicle front side. At this point, the pair of wheels 8 and the journal member 10 on the vehicle front side turn toward the vehicle front side by the angle θ with reference to the center O of the curvature radius R of the curved track. The wheel 8 and the journal member 10 on the vehicle rear side turn toward the vehicle rear side by the angle θ with reference to the center O of the curvature radius R of the curved track. As a result, the middle point 14 of the truck frame 9 passes the center between the pair of tracks 1.

The first to fourth switches 22, 23, 24 and 25 configured the same as those in the second embodiment, are provided in the vehicle in the third embodiment. A control flow of the actuator 38 involved in switching of the first to fourth switches 22, 23, 24 and 25 during curved track passage of the vehicle in the third embodiment is different from the control flow in the second embodiment in points explained below. When the first switch 22 is turned on, the actuator 38 performs the contraction operation in the front vehicle 2 on the vehicle front side. When the third switch 24 is turned on, the actuator 38 performs the contraction operation in the front vehicle 2 on the vehicle rear side. When the second switch 23 is turned on, the actuator 38 performs the expansion operation in the front vehicle 2 on the vehicle front side. When the fourth switch 25 is turned on, the actuator 38 performs the expansion operation in the front vehicle 2 on the vehicle rear side.

As explained above, with the vehicle in the third embodiment of the present invention, effects the same as those in the first embodiment are obtained. In addition, the first coupling member 31 and the second coupling member 34, pivot in association with each other. Therefore, the journal member 10 on the vehicle rear side turns in association with the journal member 10 on the vehicle front side. Therefore, even if the truck 7 is affected by force acting on the vehicle body 6, cant, slack, or the like in the curved track, the journal members 10 on the vehicle front side and the vehicle rear side, can surely turn in association with each other so as to correspond to the curved track without separately moving. As a result, the wheels 8 provided in the journal member 10, changes to a state in which the wheels 8 more surely run along the curved track. The wheels 8 can enter the curved track at a small attack angle.

With the vehicle in the third embodiment of the present invention, the second restoring rod 39 allows the first coupling member 31 and the second coupling member 34 to return from a pivoted state during curved track traveling of the vehicle to a state during linear track traveling of the vehicle. Furthermore, the second restoring rod 39 can absorb swing of the first coupling member 31 and the second coupling member 34 during the linear track traveling. It is possible to prevent occurrence of deflection of the journal members 10 and the wheels 8 involved in such swing. Therefore, it is possible to improve traveling stability during the linear track traveling of the vehicle.

With the vehicle in the third embodiment of the present invention, the actuator 38 can control the pivotal movement of the first coupling member 31 and the second coupling member 34. Furthermore, the actuator 38 operates so as to correspond to the curved track, so that the wheels 8 linked to the first coupling member 31 and the second coupling member 34 can more surely enter the curved track at a small attack angle.

The embodiments of the present invention have been explained. However, the present invention is not limited to the embodiments explained above. Various modifications and alterations are possible on the basis of the technical idea of the present invention.

For example, as a first modification of the embodiments of the present invention, regarding composition of the vehicle in the first to third embodiments, the number of front vehicles 2 and the number of intermediate vehicles 3 may be different from those in the embodiments, as long as the trucks 7 are provided in the front vehicles 2 and the one intermediate vehicle 3 is arranged between the two front vehicles 2. Advantageous effects the same as the effects explained in the embodiments can be obtained.

As a second modification of the embodiments of the present invention, a rubber vibration insulator may be provided instead of the guide washer 43 of the second restoring rod 39. Furthermore, it is possible to absorb a swing of the first coupling member 31 and the second coupling member 34, and to effectively prevent occurrence of deflection of the journal members 10 and the wheels 8 involved in the swing.

As a third modification of the embodiments of the present invention, in the third and fourth embodiments, a control operation amount of the actuators 21 and 38 may be changed so as to correspond to the curvature radius R of the curved track. The wheels 8 more surely run along the curved track. The vehicle can more smoothly travel on the curved track.

As a fourth modification of the embodiments of the present invention, in the fourth embodiment, timing on which the actuators 21 and 38 operate may be set so as to correspond to a traveling route in advance and the operation of the actuators 21 and 38, may be controlled so as to correspond to the set timing. The wheels 8 more surely run along the curved track. The wheels can travel more closely along the track.

REFERENCE SIGNS LIST

1 Track
2 Front vehicle
3 Intermediate vehicle
4 Connecting section
5 Pin connector
6 Vehicle body
7 Truck
8 Wheel
8*a*, 8*c* Axle
8*b* Wheel flange
9 Truck frame
9*a* Truck frame lateral beam
9*b* Truck frame longitudinal beam
10 Journal member
11 Conical rubber
12 Coupling member
13, 37 Stopper member
13*a*, 37*a* Stopper rubber
14 First restoring rod
15 Piston rod
15*a* Head section
15*b* Cap section
15*c* Stopper section
15*d* Rod section
16 Cylinder
16*a*, 16*b* End
17 Coil spring
18 Guide washer
19 Rubber member
21, 38 Actuator
22 First switch
23 Second switch
24 Third switch
25 Fourth switch
31 First coupling member
32 Coupling section
33 Interlocking lever
33*a* Coupling pin
34 Second coupling member
35 Coupling section
36 Interlocking lever
36*a* Long hole
39 Second restoring rod
40 Piston rod
40*a* Head section
40*b* Cap section
40*c* Rod section
41 Cylinder
41*a* Recessed section
42 Coil spring
43 Guide washer
A, B, C Arrow
D Distance
O Center
α, β, θ Angle

The invention claimed is:

1. A low floor vehicle, comprising:

a truck arranged under a vehicle body;

a truck frame configured as a frame member of the truck;

a pair of wheels being pivotable independently from each other around a same axis which extends in a vehicle width direction, and the wheels configured to travel on a track;

a journal member coupling the pair of wheels and attached to the truck frame;

a truck frame lateral beam arranged along the vehicle width direction at a position closer to a center in a vehicle longitudinal direction of the truck frame than the journal member; and a pair of truck frame longitudinal beams extending in the vehicle longitudinal direction at a position close to a center in the vehicle width direction of the pair of wheels, and being disposed spaced apart from each other in the vehicle width direction;

wherein the pair of wheels, the journal member, and the truck frame lateral beam are provided at each of a position close to a vehicle front and a position close to a vehicle rear in the truck;

wherein the journal member is configured to turn with respect to the truck frame;

wherein a coupling member couples the journal member and the truck frame lateral beam;

wherein the coupling member is attached to a center in the vehicle width direction of the truck frame lateral beam to be pivotable around an axis extending in a vehicle height direction;

wherein a restoring rod or a horizontal damper is arranged along the vehicle longitudinal direction in the truck and configured to be retractable in the vehicle longitudinal direction, one end of the restoring rod or the horizontal damper is attached to the journal member, and the other end of the restoring rod or the horizontal damper is attached to the truck frame lateral beam;

wherein an actuator is arranged on at least one of left and right exteriors in the vehicle width direction of the coupling member and is reciprocatingly moveable in the vehicle longitudinal direction, one end of the actuator is attached to the journal member, the other end of the actuator is attached to the truck frame lateral beam, and operations of the actuator are controlled so as to correspond to a linear traveling state of the vehicle and a curved traveling state of the vehicle, whereby the journal member is configured to turn with respect to the truck frame; and wherein two stopper members are provided in the truck frame, one of the stopper members is arranged at a position between the coupling member and the restricting rod or the horizontal damper and the other of the stopper members is arranged at a position between the coupling member and the actuator such that the stopper members are configured to come into contact with the coupling member to regulate pivotal movement of the coupling member.

2. A low floor vehicle comprising:

a truck arranged under a vehicle body;

a truck frame configured as a frame member of the truck;

a pair of wheels being pivotable independently from each other around a same axis which extends in a vehicle width direction, and traveling on a track;

a journal member that couples the pair of wheels and is attached to the truck frame; and a truck frame lateral beam arranged along the vehicle width direction in a position closer to a center in a vehicle longitudinal direction of the truck frame than the journal member;

wherein the pair of wheels, the journal member, and the truck frame lateral beam are respectively provided at a position close to a vehicle front and a position close to a vehicle rear of the truck;

wherein the journal member is configured to turn with respect to the truck frame;

wherein a first coupling member including a coupling section extends between the journal member and the truck frame lateral beam at a position close to the vehicle front, and an interlocking lever section extends along the vehicle longitudinal direction from the truck frame toward a center of the truck frame of the vehicle;

wherein a second coupling member including a coupling section extends between the journal member and the truck frame lateral beam at a position close to the vehicle rear, and an interlocking lever section extends along the vehicle longitudinal direction from the truck frame toward the center of the truck frame of the vehicle;

wherein the coupling section is attached to a center in the vehicle width direction of the truck frame lateral beam so as to be pivotable around an axis extending in a vehicle height direction;

wherein a coupling pin is attached to a distal end of one of the interlocking lever sections in the first coupling member and the second coupling member;

wherein a long hole extending in the vehicle longitudinal direction, is provided at a distal end of the other of the interlocking lever sections in the first coupling member and the second coupling member; and wherein the coupling pin and the long hole engage with each other, whereby the first coupling member and the second coupling member are pivotable in synchronization with each other, and the journal member is configured to turn with respect to the truck frame.

3. The low floor vehicle according to claim 2, further comprising a restoring rod or a horizontal damper being arranged in the truck along the vehicle width direction and being retractable in the vehicle width direction, wherein one end of the restoring rod or the horizontal damper is attached to one of the interlocking lever sections of the first coupling member and the second coupling member, and the other end of the restoring rod or the horizontal damper is attached to the truck frame.

4. The low floor vehicle according to claim 2, further comprising an actuator being arranged in the truck along the vehicle width direction and being reciprocatingly moveable in the vehicle width direction, wherein one end of the actuator is attached to one of the interlocking lever sections of the first coupling member and the second coupling member, the other end of the actuator is attached to the truck frame, and operations of the actuator are controlled so as to correspond to a linear traveling state of the vehicle and a curved traveling state of the vehicle, whereby the journal member is configured to turn with respect to the truck frame.

* * * * *